US009943952B2

(12) United States Patent
Kato

(10) Patent No.: US 9,943,952 B2
(45) Date of Patent: Apr. 17, 2018

(54) DRIVING TOOL

(71) Applicant: MAKITA CORPORATION, Anjo-Shi (JP)

(72) Inventor: Itsuku Kato, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 456 days.

(21) Appl. No.: 14/565,993

(22) Filed: Dec. 10, 2014

(65) Prior Publication Data

US 2015/0158160 A1 Jun. 11, 2015

(30) Foreign Application Priority Data

Dec. 11, 2013 (JP) ..... 2013256058

(51) Int. Cl.
*B25C 1/04* (2006.01)
*F15B 15/14* (2006.01)
(Continued)

(52) U.S. Cl.
CPC ..... *B25C 1/047* (2013.01); *B25C 1/06* (2013.01); *F15B 9/09* (2013.01); *F15B 15/149* (2013.01); *F15B 2211/8855* (2013.01)

(58) Field of Classification Search
CPC .. B25C 1/00; B25C 1/04; B25C 1/047; B25C 1/06; F15B 9/08; F15B 9/09; F15B 15/04; F15B 15/14; F15B 15/149
(Continued)

(56) References Cited

U.S. PATENT DOCUMENTS 1,071,387 A 8/1913 Behr
1,829,609 A 10/1931 Robinson
(Continued)

FOREIGN PATENT DOCUMENTS

JP S63229274 A 9/1988
JP H01115579 A 5/1989
(Continued)

OTHER PUBLICATIONS

Office Action dated Feb. 27, 2017 in related U.S. Appl. No. 14/391,263 and examined claims 1-20.
(Continued)

*Primary Examiner* — Gloria R Weeks
*Assistant Examiner* — William A Weller
(74) *Attorney, Agent, or Firm* — J-Tek Law PLLC; Jeffrey D. Tekanic; Scott T. Wakeman

(57) ABSTRACT

An electro-pneumatic tool drives a fastener into a workpiece by energizing an electric motor to drive a first piston and generate compressed air in a first cylinder. The compressed air is then supplied to a second cylinder and causes a second piston to move and drive the fastener into the workpiece. After the first piston has passed through its top dead center, braking is applied to the first piston according to one or more braking parameters. Then, if a control unit determines that the first piston has come to a stop at a position that is outside a predetermined range about the bottom dead center of the first piston, one or more of the braking parameters is changed in a subsequent fastener driving cycle to cause the first piston to stop closer to its bottom dead center after conclusion of the subsequent fastener driving cycle.

20 Claims, 9 Drawing Sheets

(51) Int. Cl.
*F15B 9/09* (2006.01)
*B25C 1/06* (2006.01)

(58) Field of Classification Search
USPC ..... 173/2, 4, 152; 227/1, 2, 130
See application file for complete search history.

(56) References Cited

U.S. PATENT DOCUMENTS

| | | | | |
|---|---|---|---|---|
| 3,552,274 | A | 1/1971 | Bojan et al. | |
| 3,602,103 | A | 8/1971 | Powers | |
| 3,638,534 | A | 2/1972 | Ramspeck | |
| 3,821,992 | A | 7/1974 | Matsuo | |
| 3,824,898 | A | 7/1974 | Pauliukonis | |
| 3,878,902 | A | 4/1975 | Matsuo | |
| 3,995,703 | A | 12/1976 | Wanner | |
| 4,344,555 | A | 8/1982 | Wolfberg | |
| 5,193,730 | A * | 3/1993 | Tanaka | B25C 1/008 227/113 |
| 5,605,268 | A * | 2/1997 | Hayashi | B25C 5/15 227/131 |
| 5,772,096 | A | 6/1998 | Osuka et al. | |
| 6,499,643 | B1 | 12/2002 | Hewitt | |
| 6,505,767 | B2 * | 1/2003 | Thieleke | B25C 1/08 227/10 |
| 6,604,666 | B1 * | 8/2003 | Pedicini | B25C 1/06 173/124 |
| 6,705,503 | B1 * | 3/2004 | Pedicini | B25C 1/06 173/124 |
| 6,755,336 | B2 | 6/2004 | Harper et al. | |
| 6,971,567 | B1 * | 12/2005 | Cannaliato | B25C 1/06 173/1 |
| 7,419,079 | B2 | 9/2008 | Chen et al. | |
| 7,793,811 | B1 | 9/2010 | Pedicini et al. | |
| 8,079,504 | B1 | 12/2011 | Pedicini et al. | |
| 8,523,035 | B2 * | 9/2013 | Pedicini | B25C 1/047 227/2 |
| 8,960,516 | B2 * | 2/2015 | Lijima | B25B 21/023 227/10 |
| 9,276,509 | B2 * | 3/2016 | Kato | H02P 6/15 |
| 9,438,141 | B2 * | 9/2016 | Ishikawa | B25F 5/00 |
| 9,543,871 | B2 * | 1/2017 | Kato | H02P 27/08 |
| 9,555,530 | B2 * | 1/2017 | Pedicini | B25C 1/06 |
| 2004/0232194 | A1 | 11/2004 | Pedicini et al. | |
| 2005/0001004 | A1 | 1/2005 | Fujisawa et al. | |
| 2005/0217874 | A1 | 10/2005 | Forster et al. | |
| 2007/0045377 | A1 | 3/2007 | Towfighi | |
| 2007/0138230 | A1 | 6/2007 | Gschwend et al. | |
| 2008/0017689 | A1 | 1/2008 | Simonelli et al. | |
| 2008/0073405 | A1 | 3/2008 | Shima et al. | |
| 2008/0190988 | A1 | 8/2008 | Pedicini et al. | |
| 2008/0217372 | A1 | 9/2008 | Webb | |
| 2009/0090762 | A1 | 4/2009 | Leimbach et al. | |
| 2009/0184148 | A1 | 7/2009 | Dittrich et al. | |
| 2009/0321492 | A1 | 12/2009 | Shima et al. | |
| 2010/0213235 | A1 | 8/2010 | Pedicini et al. | |
| 2010/0236802 | A1 | 9/2010 | Berger et al. | |
| 2010/0237124 | A1 | 9/2010 | Shima et al. | |
| 2010/0237126 | A1 | 9/2010 | Matsunaga et al. | |
| 2011/0108600 | A1 | 5/2011 | Pedicini et al. | |
| 2011/0155403 | A1 | 6/2011 | Rohrer | |
| 2011/0240709 | A1 | 10/2011 | Oouchi | |
| 2011/0273117 | A1 * | 11/2011 | Nakamura | B23D 51/16 318/139 |
| 2012/0019177 | A1 * | 1/2012 | Kaufmann | B25F 5/001 318/379 |
| 2012/0187178 | A1 | 7/2012 | Campbell | |
| 2012/0286014 | A1 | 11/2012 | Pedicini et al. | |
| 2014/0054350 | A1 | 2/2014 | Pedicini | |
| 2014/0158740 | A1 * | 6/2014 | Akutsu | B25C 1/044 227/130 |
| 2014/0318363 | A1 * | 10/2014 | Bennett | F01C 21/18 91/346 |
| 2014/0374461 | A1 | 12/2014 | Pedicini et al. | |
| 2015/0122868 | A1 | 5/2015 | Campbell | |
| 2015/0129630 | A1 | 5/2015 | Matsuno | |
| 2015/0158160 | A1 | 6/2015 | Kato | |
| 2015/0174748 | A1 | 6/2015 | Furuta et al. | |
| 2015/0217436 | A1 | 8/2015 | Yanagihara et al. | |
| 2015/0298308 | A1 | 10/2015 | Kato | |
| 2015/0314432 | A1 | 11/2015 | Yang et al. | |
| 2017/0001291 | A1 * | 1/2017 | Schnell | B25C 1/00 |
| 2017/0217004 | A1 * | 8/2017 | Kato | B25C 5/15 227/2 |

FOREIGN PATENT DOCUMENTS

| | | | |
|---|---|---|---|
| JP | H0270980 | U | 5/1990 |
| JP | H0396751 | A | 4/1991 |
| JP | H666967 | U | 9/1994 |
| JP | H08276375 | A | 10/1996 |
| JP | 200417206 | A | 1/2004 |
| JP | 2004017206 | A | 1/2004 |
| JP | 2005028568 | A | 2/2005 |
| JP | 2008062360 | A | 3/2008 |
| JP | 2008068353 | A | 3/2008 |
| JP | 200990384 | A | 4/2009 |
| JP | 2009172762 | A | 8/2009 |
| JP | 20105776 | A | 1/2010 |
| JP | 2010173044 | A | 8/2010 |
| JP | 2011025362 | A | 2/2011 |
| JP | 2011025363 | A | 2/2011 |
| JP | 2011056613 | A | 3/2011 |
| JP | 2012148346 | A | 8/2012 |
| JP | 2012518553 | A | 8/2012 |
| JP | 2013233608 | A | 11/2013 |
| JP | 2014083601 | | 5/2014 |
| WO | 2011010511 | A1 | 1/2011 |
| WO | 2013168718 | A1 | 11/2013 |
| WO | 2014061807 | A1 | 4/2014 |
| WO | 2014069648 | A1 | 5/2014 |

OTHER PUBLICATIONS

Office Action from the United States Patent Office dated May 15, 2017 in related U.S. Appl. No. 14/391,283, ncluding examined claims 1-12 and 14-21.
Final Office Action from the United States Patent Office dated Jun. 26, 2017 in related U.S. Appl. No. 14/391,263, including examined claims 1-20.
Unpublished U.S. Appl. No. 14/440,143.
Unpublished U.S. Appl. No. 14/685,783.
Unpublished U.S. Appl. No. 14/399,647.
Office Action from the Japanese Patent Office dated Jun. 2, 2015 in related Japanese application No. 2012-088842, and translation of substantive portions thereof.
Office Action from the Japanese Patent Office dated Jun. 2, 2015 in related Japanese application No. 2012-088843, and translation of substantive portions thereof.
Office Action from the Japanese Patent Office dated Aug. 16, 2017 in related Japanese application No. 2014-084678, and translation of substantive portions thereof.
Office Action from the Japanese Patent Office dated Feb. 3, 2016 in related Japanese application No. 2012-243442, and translation of substantive portions thereof.
Office Action from the Japanese Patent Office dated May 31, 2016 in related Japanese application No. 2012-243442, and translation of substantive portions thereof.
Office Action from the Japanese Patent Office dated Sep. 21, 2017 in related Japanese application No. 2012-243442, and translation of substantive portions thereof.
Final Office Action dated Jun. 26, 2017 in related U.S. Appl. No. 14/391,263 and examined claims 1-20.
Office Action dated Oct. 2, 2017 in related U.S. Appl. No. 14/399,647.

* cited by examiner

DRIVING TOOL

CROSS-REFERENCE TO RELATED APPLICATION

The present application claims priority to Japanese patent application serial number 2013-256058 filed on Dec. 11, 2013, the contents of which are incorporated fully herein by reference.

TECHNICAL FIELD

The present invention generally relates to a driving tool that drives a driven article, such as a fastener, into a workpiece.

BACKGROUND ART

A driving tool that drives a driven article (e.g., a fastener) into a workpiece is described in U.S. Pat. No. 8,079,504. Inside a first cylinder of the aforementioned driving tool, a first piston generates compressed air, which is communicated to a second cylinder. This compressed air causes a second piston inside the second cylinder to move and to thereby strike the driven article. Thus, the driving tool is configured to drive the driven article toward and into the workpiece. In addition, this driving tool comprises a sensor that detects the position of the first piston during the operation cycle in which the driven article is driven. Furthermore, in accordance with the position of the first piston detected by the sensor, a control unit stops the flow of electric current to a motor and thereby stops the first piston.

SUMMARY OF THE INVENTION

However, in the above-described driving tool, if the first piston does not stop at the prescribed (most appropriate) position (in particular, its bottom dead center) after conclusion of the driving operation, then problems might arise during the next operation to drive the next driven article, such as an insufficient or excessive compression of air during the next driving operation. Accordingly, one non-limiting object of the present disclosure is to provide one or more techniques that enable multiple driving operations (including, e.g., so-called "continuous operations") to be smoothly and reliably performed with such a driving tool.

According to a first aspect of the present disclosure, a driving tool, such as e.g., a nailer (nail gun) or a stapler, preferably comprises: a first cylinder; a first piston, which is slidably housed within the first cylinder; a drive mechanism that drives the first piston; a second cylinder, which communicates with the first cylinder; a second piston, which is slidably housed within the second cylinder; a communication path, which provides communication between the first cylinder and the second cylinder; a valve member, which is provided in the communication path; a sensor for detecting the position of the first piston; and a controller for controlling the driving of the first piston. The driving tool is preferably configured such that, when the valve member is closed and communication (fluid communication) between the first cylinder and the second cylinder is thereby blocked, compressed air is generated by the sliding (movement) of the first piston inside the first cylinder. Then, by subsequently opening the valve member and supplying the compressed air inside the first cylinder to the second cylinder via the communication path, the second piston is forcibly moved (slid) by the compressed air. As a result, the driven article is driven out of an ejection port by the movement of the second piston caused by the compressed air. In such a driving tool, the controller causes the first piston to stop by applying braking, e.g., according to one or more braking parameters, to the first piston after the first piston passes (has passed) through its top dead center. In this aspect, "braking of the first piston" preferably includes not only directly braking the moving first piston, but also controlling (reducing/braking) the driving speed of one or more driving elements configured to drive the first piston, such as an electric motor and/or a driving shaft operably coupled to the first piston to transmit driving motion to the driving shaft. For example, the present teachings also encompass controlling (reducing) the driving speed/motion (either rotational or linear movement) of an intermediate element (e.g., a crankshaft) within the drive train of the first piston.

In such a driving tool, it is possible that the stopped position of the first piston, which is detected by the sensor after completion of a first driving operation for driving a driven article ends, is a position other than the bottom dead center of the first piston (or is outside of a predetermined range about the bottom dead center). In this case, the controller is preferably configured to modify braking control performed on the first piston such that, after a second driving operation ends following the first driving operation, the stopped position of the first piston is closer to the bottom dead center than after the first driving operation ended. Possible modifications of the braking control preferably include, but are not limited to, modification of the braking start time, modification of the braking force, and/or modification of the braking time (i.e. the amount of time braking is applied to the first piston).

According to the first aspect of the present disclosure, even if the first piston is not positioned at its bottom dead center (or within a predetermined range about its bottom dead center) after a driving operation has concluded, the stopped position of the first piston is made to more closely approach bottom dead center after the next driving operation. That is, the driving and/or braking of the first piston is/are adjusted such that the stopped position of the first piston is closer to its bottom dead center. In this case, in a third driving operation that follows the second driving operation, the movement of the first piston will be started from its bottom dead center, or closer thereto than if no modification of the braking control had taken place. Consequently, multiple driving operations can be performed in succession more smoothly, reliably and accurately; in particular the amount of force applied to the driven article (fastener) in each driving operation remains constant, or at least substantially constant. That is, by ensuring the compression (first) piston is positioned at (or close to) its bottom dead center prior to each driving operation, the quantity of compressed air generated inside the first cylinder will be constant, or at least substantially constant, in every driving operation. As a result, the driving speed of the driven articles remains stable (at least substantially constant) over a plurality of driving operations. Such an embodiment is particularly useful in continuous driving operations, in which multiple driving operations are performed successively, usually in a relative short time period, as will be further discussed below.

According to another aspect of the present disclosure, the controller is preferably configured to brake the first piston during the first driving operation when a first prescribed (or predetermined) amount of time has elapsed since the start of movement of the first piston from its bottom dead center. However, in this case, it is possible that the stopped position of the first piston after the first driving operation ends is a position other than its bottom dead center (or is outside of a predetermined range about the bottom dead center). In this case, the controller is preferably configured to brake the first piston during the second (next) driving operation when a second amount of time, whose length differs from that of the first amount of time, has elapsed since the start of movement of the first piston from its bottom dead center. For example, if the first piston stops beyond (after passing through) its bottom dead center after completion of the first driving operation, then the controller preferably sets the second amount of time to an amount of time that is shorter than the first amount of time. On the other hand, if the first piston stops before its bottom dead center after completion of the first driving operation (i.e. the first piston does not reach or pass through its bottom dead center), then the controller preferably sets the second amount of time to an amount time that is longer than the first amount of time. Then, in the second driving operation, the controller causes the first piston to be braked when the second amount of time has elapsed since the start of movement of the first piston from its bottom dead center. That is, the controller is preferably configured to modify, change, shift or adjust the braking start timing in the second driving operation as compared to the braking start timing in the first driving operation. In addition or in the alternative, because the elapsed time since the start of movement of the first piston from its bottom dead center corresponds substantially one-to-one with the position of the first piston, the present disclosure naturally also encompasses configurations that cause the first piston to be braked based on the (detected or sensed) position of the first piston, as will be further described herein.

According to the above-described aspect, the stopped position of the first piston after completion of the second driving operation is adjusted by modifying (changing, shifting or adjusting) the braking start timing. Accordingly, it is possible to easily modify the drive control (or brake control), and thus the stopped position, of the first piston.

According to yet another aspect of the present disclosure, the controller is preferably configured to brake the first piston during the first driving operation by causing a prescribed (or predetermined) first braking force to be applied to the first piston when a prescribed (predetermined) amount of time (or a prescribed/predetermined amount of rotation of a rotating element, such as the motor shaft or a crankshaft coupled thereto) has elapsed since the start of movement of the first piston from its bottom dead center. However, it is again possible that the stopped position of the first piston after the first driving operation ends is a position other than its bottom dead center (or is outside of a predetermined range about the bottom dead center). In this case, the controller is configured to cause the braking to be applied the first piston during the second (next) driving operation at a second braking force, which differs from the first braking force, when the prescribed amount of time has elapsed (or a corresponding amount of rotation of the rotating element has taken place) since the start of movement of the first piston from its bottom dead center. The braking force is defined or determined, in part, by the rate at which the speed of the first piston, which is decelerated by being braked, is reduced per unit of time. The second braking force is determined and set by the controller based on the stopped position of the first piston after the first driving operation ends. For example, if the first piston stops beyond (after passing through) its bottom dead center after completion of the first driving operation, then the second braking force in the second driving operation is set to be greater than the first braking force. On the other hand, if the first piston stops before its bottom dead center after completion of the first driving operation (before reaching or passing through its bottom dead center), then the second braking force in the second driving operation is set to be less than the first braking force.

According to the above-described aspect, the stopped position of the first piston after the second driving operation is adjusted by modifying, changing or adjusting the braking force applied to the first piston during the second driving operation (i.e. after the first piston has passed its top dead center). Accordingly, the first piston can be stopped more precisely at (or closer to) its bottom dead center by appropriately adjusting the braking force applied during the second driving operation. It is noted that the braking force may be a constant braking force from the start of the braking to the end of the braking, or the braking force may be varied in accordance with the elapsed time since the start of the braking. If the braking force changes after the start of braking, then an average braking force from the start to the end of braking may be defined as the braking force.

According to yet another aspect of the present disclosure, when a prescribed time has elapsed (or a corresponding amount of rotation of the rotating element has taken place) in the first driving operation since the start of movement of the first piston from it bottom dead center, the controller is preferably configured to cause the first piston to be braked continuously for a first braking time (i.e. a braking force is applied for a first amount of time). However, it is again possible that the stopped position of the first piston after the first driving operation ends is a position other than its bottom dead center (or is outside of a predetermined range about the bottom dead center). In this case, when the prescribed time has elapsed since the start of movement of the first piston from its bottom dead center in the second driving operation, the controller is configured to cause the first piston to be braked continuously for a second braking time, whose length (amount of time) differs from that of the first braking time. In this respect, it is noted that the modification of the length (amount) of the braking time for which the first piston is braked has the effect of modifying the total amount of braking force that is applied to the first piston, in particular if the instantaneous braking force remains constant throughout the braking operation.

According to yet another aspect of the present disclosure, the drive mechanism preferably comprises a crank mechanism configured to reciprocally (linearly) drive the first piston. The crank mechanism preferably comprises a crankshaft and a linking member, which links (operably couples) the crankshaft to the first piston. The sensor may be configured to detect (sense) the (rotational) position of the crankshaft. In this case, the controller is preferably configured to calculate the (instantaneous) crank angle of the crankshaft based on the detection result of (the rotational position sensed by) the sensor. In this aspect, the controller is preferably configured to cause the braking to be applied to the first piston during the first driving operation when the crank angle is (becomes or reaches) a first (prescribed or predetermined) angle. However, it is again possible that the stopped position of the first piston after the first driving operation ends is a position other than its bottom dead center (or is outside of a predetermined range about the bottom dead center). In this case, the controller is configured to cause the braking to be applied to the first piston during the second (next) driving operation when the crank angle is (reaches or becomes) a second angle, which differs from the first angle. For example, if the first piston stops beyond (after passing through) its bottom dead center after completing the first driving operation, then the controller is configured to set the second angle to be smaller than the first angle. On the other hand, if the first piston stops before the bottom dead center after completing the first driving operation (before reaching or passing through its bottom dead center), then the controller is configured to set the second angle to be larger than the first angle. Therefore, in the second driving operation, the controller is configured to cause the braking to be applied to the first piston when the crank angle is (reaches or becomes) the second angle. That is, the controller sets the braking start timing based on the crank angle of the crankshaft. In other words, because the elapsed time since the start of movement of the first piston from its bottom dead center corresponds substantially one-to-one to the crank angle, which is the position of the first piston, the elapsed time since the start of movement of the first piston from bottom dead center is defined by the crank angle of the crankshaft. The crank angle of the crankshaft is set to 0° when the first piston is positioned at its bottom dead center, and is set to 180° when the first piston is positioned at its top dead center. Accordingly, the crank angle of the crankshaft is 360° when the first piston is once again positioned at its bottom dead center; at this time, the crank angle is reset to 0°.

According to yet another aspect of the present disclosure, the drive mechanism preferably comprises an electric motor configured to drive the first piston. Furthermore, the controller is preferably configured such that the first piston is braked by controlling the drive (e.g., rotary output) of the electric motor. For example, the first piston may be braked by actively causing the rotational speed (rotary output) of the electric motor to reduce by performing short-circuit control or pulse width modulation (PWM) control on the electric motor, as will be further discussed below.

According to the above-described aspect, the first piston is braked by controlling the drive (energization) of the electric motor. Accordingly, such embodiments do not require a braking apparatus, which is separate from the electric motor, in order to brake the first piston. However, in alternative embodiments, e.g., one or more braking pads may be utilized to apply the braking force to the first piston, e.g., by squeezing the braking pad(s) around a rotary shaft, such as the rotary output shaft of the electric motor, the crankshaft, etc.

According to yet another aspect of the present disclosure, the drive mechanism again preferably comprises the crank mechanism for driving the first piston and the crank mechanism preferably comprises the crankshaft and the linking member, which links (operably couples) the crankshaft and the first piston. In this aspect, the sensor is preferably configured to detect the position (e.g., a rotational position or angular position) of a constituent (structural) element (moving element) selected from the group consisting of the crankshaft, the linking member, and a rotary shaft of the motor. In this case, the controller is preferably configured to (indirectly) calculate the position of the first piston based on the detection result (output signal) of the sensor.

According to the above-described aspect, the sensor is configured to indirectly detect the position of the first piston by measuring the (rotational or angular) position of the crankshaft, the linking member, or the motor rotary shaft, instead of directly detecting the (linear) position of the first piston. In some embodiments of the present teachings, it may be difficult to directly measure the position of the first piston because it is housed inside the first cylinder. Nevertheless, according to the present aspect, the position of the first piston can be easily and reliably detected (determined) without directly measuring it.

According to yet another aspect of the present disclosure, the sensor (and/or the controller) is (are) preferably configured to detect (directly or indirectly) the position of the first piston prior to the start of the first driving operation. In this case, if the position of the first piston is determined to be a position other than its bottom dead center, then the controller is preferably configured to move the first piston to (or more closely towards) its bottom dead center before the start of the next driving operation.

According to the above-described aspect, even if the first piston did not stop at or near its bottom dead center after the preceding driving operation, the first piston can be moved to its bottom dead center prior to the start of each subsequent driving operation. Consequently, the degree (or pressure), to which the air is compressed by the first piston, is constant (or at least substantially constant) for every driving operation.

According to another aspect of the present disclosure, a method of operating an electro-pneumatic tool to drive a fastener into a workpiece preferably comprises energizing an electric motor to drive a first piston and generate compressed air in a first cylinder. The compressed air is then supplied to a second cylinder and causes a second piston to move and drive ("hammer") the fastener into the workpiece. After the first piston has passed through its top dead center, braking is applied to the first piston according to one or more braking parameters, such as braking start time, braking force and/or the amount of braking time. Then, if a control unit determines that the first piston has come to a stop at a position that is outside a predetermined range about the bottom dead center of the first piston, one or more of the braking parameters is changed in a subsequent fastener driving cycle to cause the first piston to stop closer to its bottom dead center after conclusion of the subsequent fastener driving cycle.

Additional objects, features, embodiments, effects and advantages of the present disclosure will become apparent after reading the following detailed description and claims in view of the appended drawings.

DETAILED DESCRIPTION OF THE EMBODIMENTS

First Embodiment

A first embodiment will be explained below, with reference to FIG. 1 through FIG. 9, as a representative embodiment of the present disclosure. The first embodiment is explained using an electro-pneumatic nailer as one non-limiting example of a driving tool according to the present disclosure. As shown in the overall views of FIG. 1 and FIG. 2, a nailer (nail gun) 100 may principally comprise a main-body housing 101 and a magazine 105. The main-body housing 101 is defined as a tool main body and forms an outer wall (shell) of the nailer 100. The magazine 105 is loaded with nails (not illustrated), which serve as driven articles that are to be driven into a workpiece. The main-body housing 101 is formed by joining a pair of substantially symmetrical housings together. The main-body housing 101 integrally comprises a handle (handle part) 103, a driving-mechanism housing part 101A, a compressing-apparatus housing part 101B, and a motor-housing part 101C.

Figure 1:
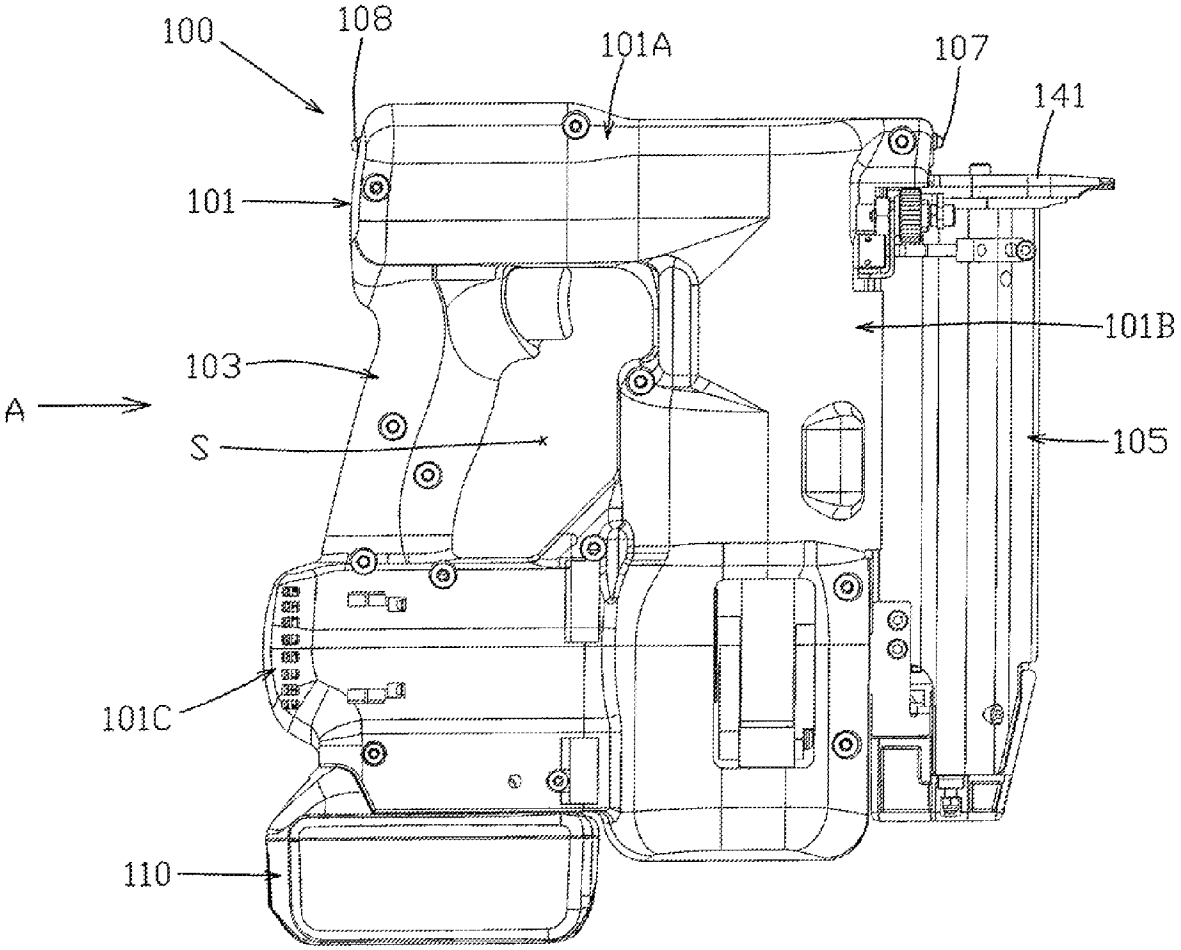
FIG. 1 is an external view that shows the overall configuration (appearance) of an electro-pneumatic nailer according to a representative embodiment of the present disclosure.
Figure 2:
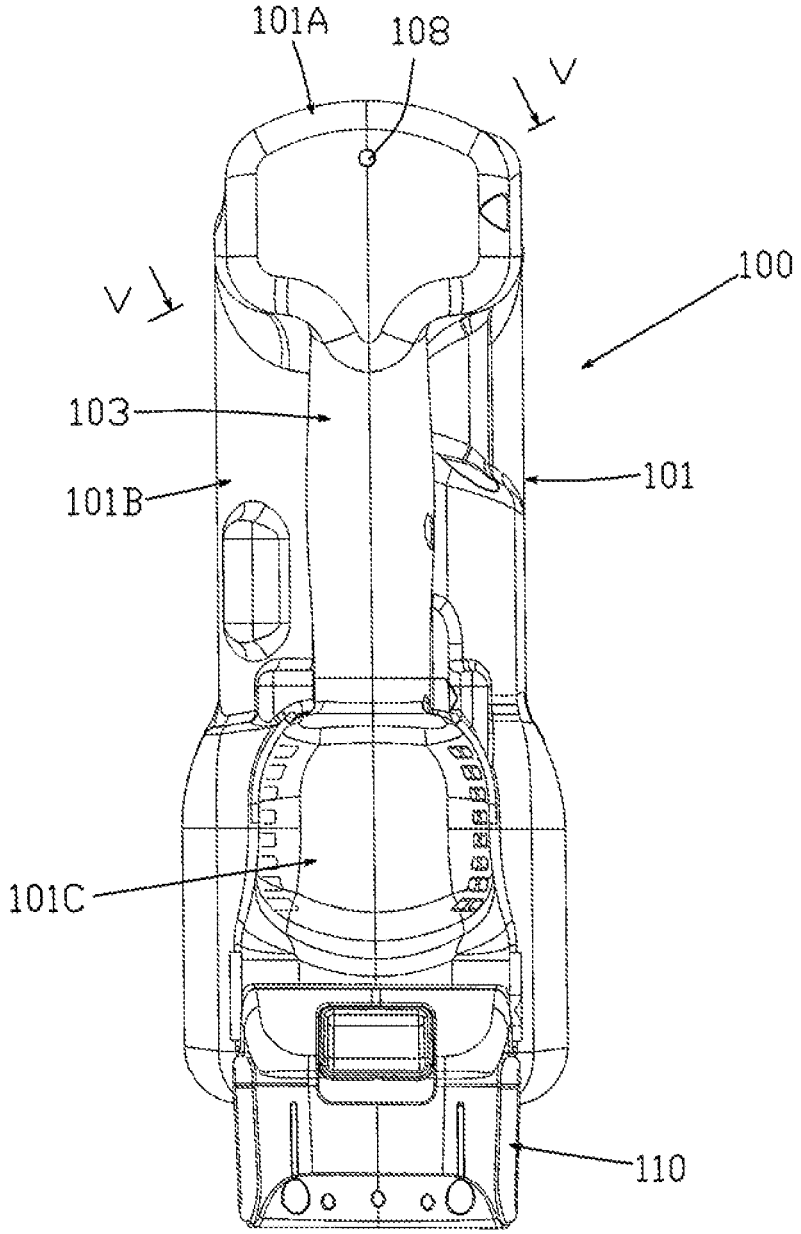
FIG. 2 is a view taken in the direction of arrow A shown in FIG. 1.

The handle part 103, the driving-mechanism housing part 101A, the compressing-apparatus housing part 101B, and the motor-housing part 101C are disposed such that, in a side view of the nailer 100 (as shown in FIG. 1), they generally form a quadrangle, e.g., a rectangle. The handle part 103 is an elongated member that extends with a prescribed length, one end side of which is joined (connected) to the driving-mechanism housing part 101A and the other end side of which is joined (connected) to the motor-housing part 101C. Moreover, the compressing-apparatus housing part 101B extends substantially parallel to the handle part 103, wherein one end side of the compressing-apparatus housing part 101B is joined (connected) to the driving-mechanism housing part 101A and the other end side is joined (connected) to the motor-housing part 101C. Consequently, a (hollow) space S, which is surrounded by the handle part 103, the driving-mechanism housing part 101A, the compressing-apparatus housing part 101B, and the motor-housing part 101C, is formed in the nailer 100.

As shown in FIG. 1, a driver guide 141 and an LED 107 are disposed at a tip part (the right end in FIG. 1) of the nailer 100. The rightward direction in FIG. 1 is the nail driving direction. Furthermore, for the sake of convenience of explanation, the tip side (the right side in FIG. 1) of the nailer 100 will be referred to as the "front side", and the opposite side thereof (the left side in FIG. 1) will be referred to as the "rear side". In addition, the side of the nailer 100 (the upper side in FIG. 1), to which the driving-mechanism housing part 101A of the handle part 103 is joined, will be called the "upper side"; the side of the nailer 100 (the lower side in FIG. 1), to which the motor-housing part 101C of the handle part 103 is joined, will be called the "lower side".

Figure 3:
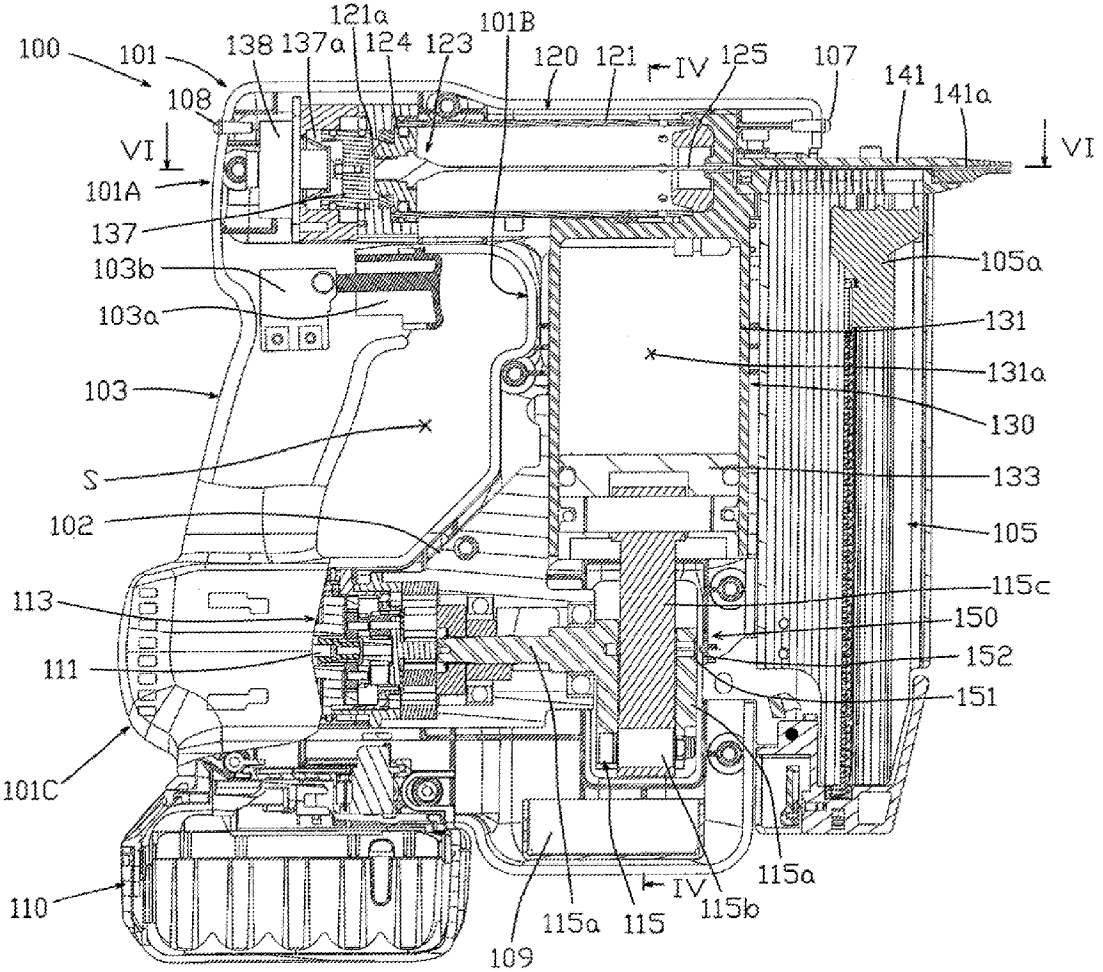
FIG. 3 is a cross-sectional view that shows the overall configuration of the internal components of the nailer.

As shown in FIG. 3, the driving-mechanism housing part 101A houses a nail-driving mechanism 120. The nail-driving mechanism 120 principally comprises a driving cylinder 121 and a driving piston 123. In the present embodiment, the driving cylinder 121 serves as a representative example of the "second cylinder" in the present disclosure, and the driving piston 123 serves as a representative example of the "second piston" in the present disclosure.

The driving piston 123 that strikes/drives ("hammers") the nails (fasteners) is housed within the driving cylinder 121 so as to be slidable in the front-rear direction (the longitudinal axis direction of the driving cylinder 121). The driving piston 123 comprises a piston-main-body part 124, which is slidably housed within (in sliding contact with) the driving cylinder 121, and an elongated driver 125, which is configured to strike and (hammer) drive the nails, is integrally provided with the piston-main-body part 124, and extends forward therefrom. The piston-main-body part 124 and the elongated driver 125 are configured such that they are capable of being linearly moved in the forward direction (towards the front side) in the longitudinal axis direction of the driving cylinder 121 by supplying compressed air into a cylinder chamber 121*a*. The compressed air causes the elongated driver 125 to move forward within a driving passage 141*a* of the driver guide 141 to drive a nail. The cylinder chamber 121*a* is formed (defined) as a space that is surrounded by an inner wall surface of the driving cylinder 121 and a rear side surface of the piston-main-body part 124. The driver guide 141 comprises the driving passage 141*a*, which is disposed at a tip (end) part of the driving cylinder 121 and has a nail ejection port (tool nozzle) at its tip.

As shown in FIG. 1, the magazine 105 is disposed on the tip (front) side of the main-body housing 101, i.e. forward of the compressing-apparatus housing part 101B. The magazine 105 is operably coupled to the driver guide 141 and supplies the nails to the driving passage 141*a*. Furthermore, as shown in FIG. 3, the magazine 105 is provided with a pusher plate 105*a* that pushes (urges) the nails in a supplying direction (upward in FIG. 3). Thus, the nails are supplied, one nail at a time, by the pusher plate 105*a* to the driving passage 141*a* of the driver guide 141 from a direction that intersects (e.g., is orthogonal to) the driving direction.

As shown in FIG. 3, the compressing-apparatus housing part 101B houses a compression apparatus (compressor or compressed air generator) 130. The compression apparatus 130 principally comprises a compression cylinder 131, a compression piston 133 and a crank mechanism 115. The compression piston 133 is disposed such that it is capable of reciprocally sliding in the up-down directions (as viewed in FIG. 3) inside the compression cylinder 131. In the present embodiment, the compression cylinder 131 serves as a representative example of the "first cylinder" in the present disclosure and the compression piston 133 serves as a representative example of the "first piston" in the present disclosure.

The compression cylinder 131 is disposed alongside (parallel to) the magazine 105, and an upper-end side of the compression cylinder 131 is joined (coupled) to a front-end part of the driving cylinder 121. Furthermore, the compression piston 133 is disposed such that it reciprocally slides in the up-down directions alongside (parallel to) the magazine 105. Thus, the operation (reciprocal movement) direction of the compression piston 133 is substantially orthogonal to the operation (reciprocal movement) direction of the driving piston 123. The volume of a compression chamber 131*a*, which is the internal space of the compression cylinder 131, changes when the compression piston 133 slides in the up-down directions. That is, the movement of the compression piston 133 toward the upward side, which reduces the volume of the compression chamber 131*a*, causes air in the compression chamber 131*a* to be compressed. The compression chamber 131*a* is formed on an upper part side that is proximate to the driving cylinder 121. In addition, the compression cylinder 131 comprises a not-shown air release valve (atmosphere open valve) configured to selectively open the compression chamber 131*a* to the atmosphere. The air release valve is held in a closed state during a driving operation and switches to an open state at times other than during the driving operation.

As shown in FIG. 3, the motor-housing part 101C houses an electric motor 111. The electric motor 111 is disposed such that its rotary shaft is preferably at least substantially parallel to the longitudinal axis of the driving cylinder 121. Accordingly, the longitudinal direction of the rotary shaft of the electric motor 111 is preferably at least substantially orthogonal to the operation (reciprocal movement) direction of the compression piston 133. Furthermore, a battery mounting area is formed on a lower part side of the motor-housing part 101C, and a rechargeable battery pack 110 that supplies electric current (power) to the electric motor 111 is detachably mounted to the battery mounting area.

As shown in FIG. 3, the rotational speed (rotary output) of the electric motor 111 is reduced by a planetary-gear-type, speed-reducing mechanism 113, after which the rotation (rotational energy/movement) is transmitted to the crank mechanism 115. Furthermore, the rotation (rotary output) of the electric motor 111 is converted into reciprocating linear motion by the crank mechanism 115 that is then transmitted to (drives) the compression piston 133. The speed-reducing mechanism 113 and the crank mechanism 115 are housed inside an inner-side housing 102, which is disposed over a rearward area of the compressing-apparatus housing part 101B and a forward area of the motor-housing part 101C.

The crank mechanism 115 principally comprises a crankshaft 115*a*, an eccentric pin 115*b*, and a connecting rod 115*c*. The crankshaft 115*a* is linked to the planetary-gear-type, speed-reducing mechanism 113 and is rotationally driven by the speed-reducing mechanism 113. The eccentric pin 115*b* is provided at a position that is offset from the center of rotation of the crankshaft 115*a*. One end of the connecting rod 115*c* is pivotably connected to the eccentric pin 115*b*, and the other end of the connecting rod 115*c* is pivotably connected to the compression piston 133. The crank mechanism 115 is disposed below the compression cylinder 131. In the above-described configuration, the compression apparatus 130 is configured as a reciprocating-type compression apparatus that principally comprises the compression cylinder 131, the compression piston 133 and the crank mechanism 115. In the present embodiment, the crank mechanism 115 and the electric motor 111 serve as a representative example of the "drive mechanism" in the present disclosure.

Figure 9:
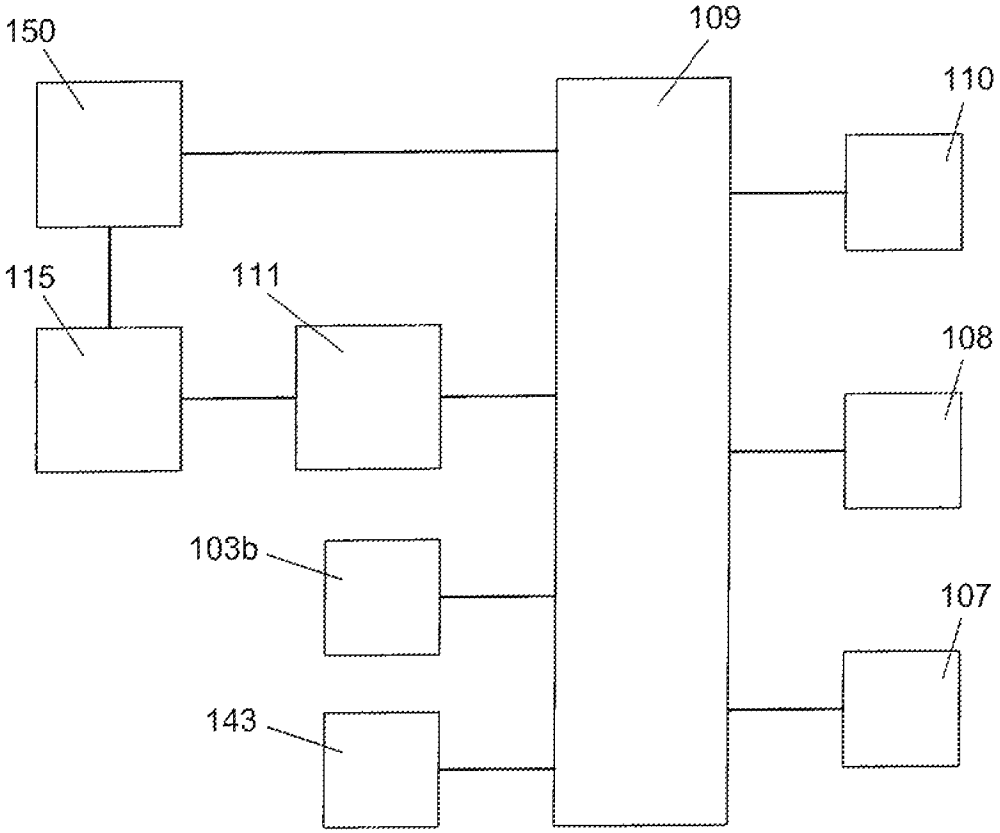
FIG. 9 is a block diagram that shows a representative control system for operating the nailer.

As shown in FIG. 3, the handle part 103 is provided with a trigger 103*a* and a trigger switch 103*b*. In addition, a control unit (controller) 109 is disposed below the crank mechanism 115. As shown in FIG. 9, the control unit 109 is electrically connected to an electromagnet 138, a contact-arm switch 143, the trigger switch 103*b*, the electric motor 111, a magnetic sensor 150 and the battery pack 110. Furthermore, the electric motor 111 is controlled by the control unit 109 in accordance with the operation of the trigger 103*a*, which is provided on the handle part 103, and the operation of the driver guide 141, which is provided at the tip area of the main-body housing 101, as will be further described below.

Figure 6:
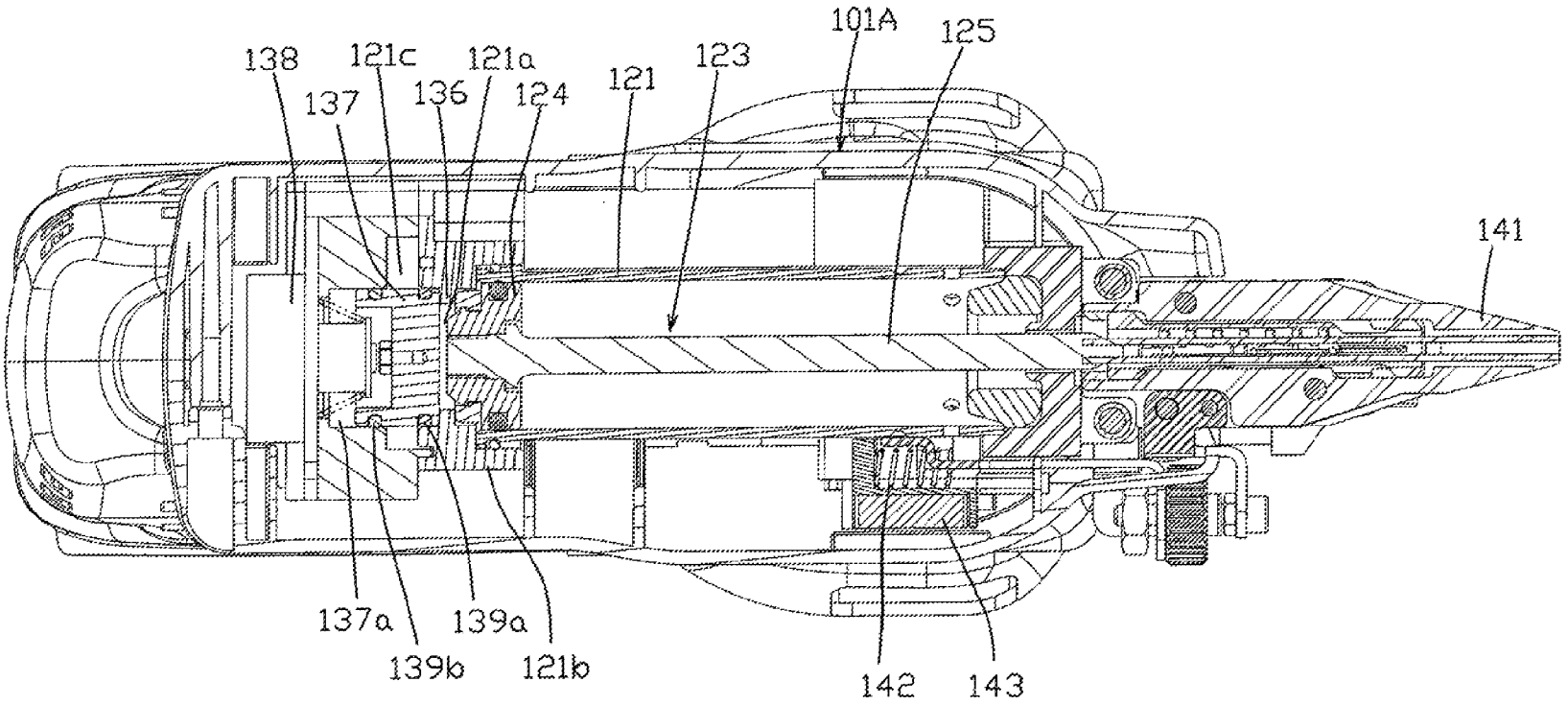
FIG. 6 is a cross-sectional view taken along line VI-VI shown in FIG. 3 and shows the state in which a valve is closed.

The trigger switch 103*b* transitions to the ON state when the user pulls or squeezes the trigger 103*a*, and transitions to the OFF state when the user releases the trigger 103*a*. Furthermore, the trigger 103*a* is disposed such that it protrudes toward (projects into) the (hollow) space S, which is surrounded by the handle part 103, the driving-mechanism housing part 101A, the compressing-apparatus housing part 101B, and the motor-housing part 101C. The driver guide 141 is configured to serve as a contact arm and is disposed at the tip area of the main-body housing 101 such that it is capable of moving in the front-rear directions of the nailer 100. As shown in FIG. 6, the driver guide 141 is biased forward by a biasing spring 142. Furthermore, when the driver guide 141 is positioned (moves) forward, the contact-arm switch 143 transitions to the OFF state; when the driver guide 141 moves (relative to the magazine 105) towards the main-body housing 101 side, the contact-arm switch 143 transitions to the ON state. Furthermore, the electric motor 111 is energized and driven when the trigger switch 103*b* and the contact-arm switch 143 are both switched to the ON state, and stops when either the trigger switch 103*b* or the contact-arm switch 143 switches to the OFF state.

Figure 5:
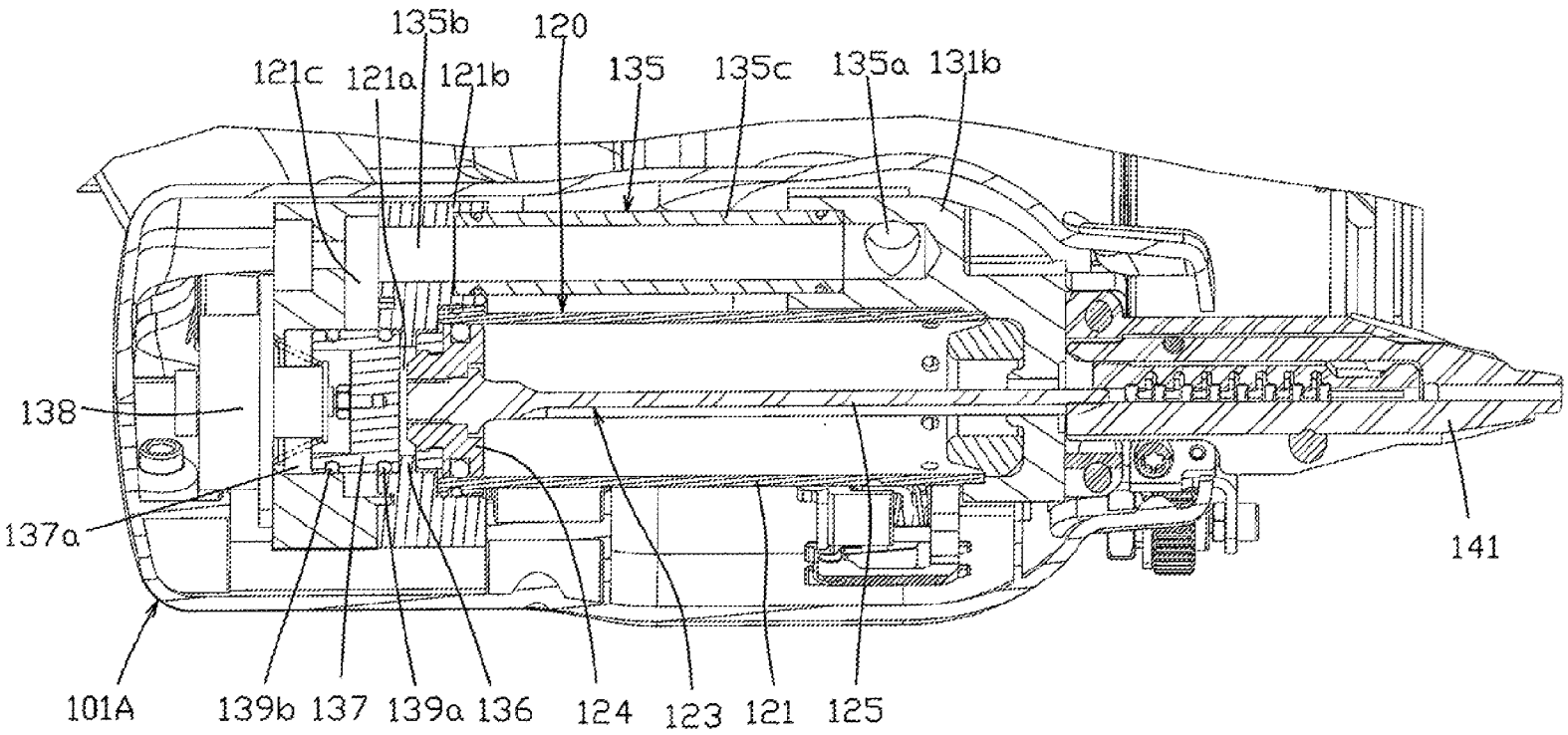
FIG. 5 is a cross-sectional view taken along line V-V shown in FIG. 2.

As shown in FIG. 5, the nailer 100 has an air passage 135 and a valve chamber 137*a* that provide (fluid, i.e. compressed air) communication between the compression chamber 131*a* of the compression cylinder 131 and the cylinder chamber 121*a* of the driving cylinder 121.

Figure 4:
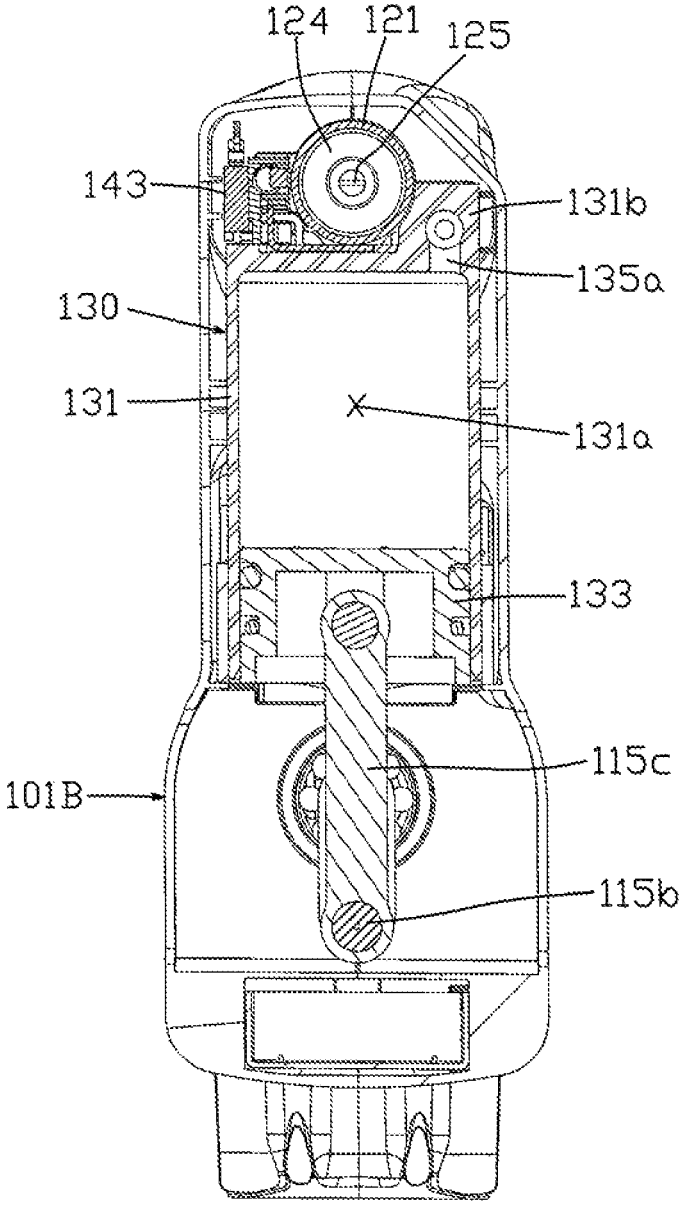
FIG. 4 is a cross-sectional view taken along line IV-IV shown in FIG. 3.

As shown in FIG. 5, the air passage 135 principally comprises a (first) communication port 135*a*, a (second) communication port 135*b* and a communication path (tube) 135*c*. An annular groove 121*c* and the valve chamber 137*a* are in fluid communication with the air passage 135. As shown in FIG. 4, the (first) communication port 135*a* is formed (defined) in a cylinder head 131*b* of the compression cylinder 131. The (second) communication port 135*a* is proximate to and communicates with the compression chamber 131*a*. In addition, as shown in FIG. 5, the (second) communication port 135*b* is formed (defined) in a cylinder head 121*b* of the driving cylinder 121. The (second) communication port 135*b* communicates with the valve chamber 137*a*. The communication path 135*c* provides communication between the (first) communication port 135*a* and the (second) communication port 135*b*. The communication path 135*c* is formed as (defined by) a pipe-shaped (hollow) member and extends linearly in the front-rear direction alongside (parallel to) the driving cylinder 121. In the present embodiment, the air passage 135 serves as a representative example of the "communication path" in the present disclosure.

As shown in FIG. 5, the (second) communication port 135*b* is proximate to and communicates with the annular groove 121*c*, which is formed (defined) in a circumferential surface of the valve chamber 137*a*. Thus, the annular groove 121*c* is proximate to and communicates with the valve chamber 137*a*. Furthermore, the valve chamber 137*a* is proximate to and communicates with the cylinder chamber 121*a*. Thus, the (second) communication port 135*b* communicates with the cylinder chamber 121*a* via the annular groove 121*c* and the valve chamber 137*a*. A solenoid valve 137, which opens and closes the air passage 135, is housed in the valve chamber 137*a*. In the present embodiment, the solenoid valve 137 serves as a representative example of the "valve member" in the present disclosure.

The solenoid valve 137 is a cylindrical member (e.g., it has a cylindrical shape, preferably a circular cylindrical shape) and has a diameter that is substantially the same as the diameter of the piston-main-body part 124 of the driving piston 123. The solenoid valve 137 is disposed within the valve chamber 137*a* and is capable of reciprocally moving in the front-rear directions inside the valve chamber 137*a*. The electromagnet 138 is disposed rearward of the solenoid valve 137. The solenoid valve 137 is moved in the front-rear directions by switching ON and OFF the electric current supply to the electromagnet 138. Two O-rings 139*a*, 139*b* are disposed on the outer circumference of the solenoid valve 137 at a prescribed spacing in the front-rear direction, as will be further described below. The solenoid valve 137 opens and closes the annular groove 121*c* by moving rearward and forward, respectively.

Figure 7:
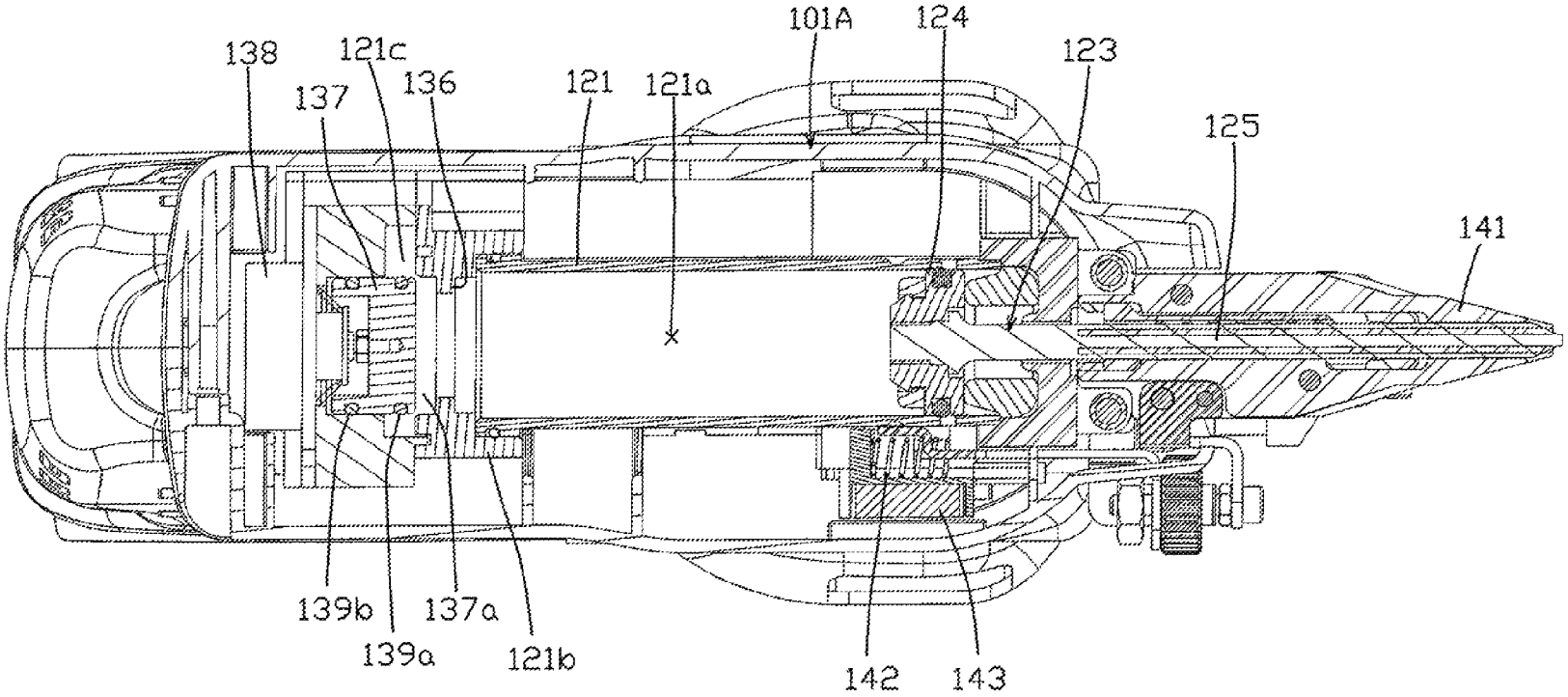
FIG. 7 shows a nailing state in which the valve in FIG. 6 has opened and the driving (second) piston has moved forward.

More specifically, as shown in FIG. 6, the front side O-ring 139*a* cuts off (blocks) the (fluid) communication between the annular groove 121*c* and the cylinder chamber 121*a* by making contact with the cylinder head 121*b*, which forms part of the inner wall surface of the valve chamber 137*a* forward of the annular groove 121*c*. Moreover, as shown in FIG. 7, when the O-ring 139*a* moves into the range (span) of the annular groove 121*c*, the annular groove 121*c* (fluidly) communicates with the cylinder chamber 121*a*. Furthermore, the rear side O-ring 139*b* is designed to prevent the compressed air from leaking out of the (second) communication port 135*b* and does not contribute to the opening or closing of the annular groove 121*c*. Thus, the solenoid valve 137, which opens and closes the air passage 135, is provided on the side of the air passage 135 on which the cylinder chamber 121*a* of the driving cylinder 121 is (fluidly) connected.

As shown in FIG. 6, the solenoid valve 137 is disposed (biased) forward by the electromagnet 138 such that the annular groove 121*c* is normally closed (sealed or blocked). In addition, a stopper 136 is disposed forward of the solenoid valve 137 and limits the forward movement of the solenoid valve 137. The stopper 136 is formed by a flange-shaped member that protrudes in the radial direction inside the cylinder chamber 121*a*. Furthermore, the stopper 136 also defines or limits the rearmost position of the rearward movement of the driving piston 123.

In addition, as shown in FIG. 3, the nailer 100 comprises the magnetic sensor 150. The magnetic sensor 150 detects the position of the crankshaft 115*a* based on the Hall effect, which is generated by a Hall-effect device 152 as a result of the magnetic field of a magnet 151. Thus, the magnetic sensor 150 principally comprises the magnet 151 and the Hall-effect device 152. The magnet 151 is preferably provided on the crankshaft 115*a* and the Hall-effect device 152 is preferably provided at a position along the compressing-apparatus housing part 101B that opposes the magnet 151. The Hall-effect device 152 is electrically connected to the battery pack 110 and to the control unit 109. In addition, in view of the fact that the magnetic flux density sensed by the Hall-effect device 152 varies with the (rotational) position of the magnet 151, the control unit 109 measures the (rotational) position of the crankshaft 115*a* via the magnetic sensor 150 based on the output voltage (signal) of the Hall-effect device 152, which corresponds to the sensed magnetic flux density. Based upon this sensor output signal, the position of the compression piston 133, which is connected to the crankshaft 115*a*, can be calculated. In the magnetic sensor 150, a plurality of Hall-effect devices 152 may be provided on the compressing-apparatus housing part 101B in the rotational direction of the crankshaft 115*a* so that the position of the crankshaft 115*a* can be precisely detected. The magnetic sensor 150 in the present embodiment serves as a representative example of the "sensor" in the present disclosure.

Next, the operation and a method of using the nailer 100 will be explained. As shown in FIG. 3, the "initial position" of the nailer 100 is defined as the state in which the driving piston 123 is positioned at the rear-end (its rearmost) position (the left end position in FIG. 3) and the compression piston 133 is positioned at the lower end (its lowermost) position (bottom dead center). That is, the initial state corresponds to a crank angle of the crankshaft 115*a* of 0° (bottom dead center).

In the initial state shown in FIG. 3, when the driver guide 141 is pushed against the workpiece such that the contact-arm switch 143 (see FIG. 6) is in the ON state and when the trigger 103*a* is pulled such that the trigger switch 103*b* switches to the ON state, the electric motor 111 is energized and its rotary output shaft is rotatably driven. As a result, the crank mechanism 115 is rotatably driven via the speed-reducing mechanism 113, and the compression piston 133 is caused to move upward from its bottom dead center. At this time, because the solenoid valve 137 is disposed in a position that closes or blocks the air passage 135, the air inside the compression chamber 131*a* is compressed by the (upward) movement of the compression piston 133.

When the compression piston 133 reaches an upper end position (its top dead center), which corresponds to the state in which the crank angle of the crankshaft 115*a* is 180° as measured by the magnetic sensor 150, the compressed air inside the compression chamber 131*a* reaches its maximum compression state. At this time, the solenoid valve 137 is moved rearward by the electromagnet 138. As a result, the annular groove 121*c* is permitted to fluidly communicate with the cylinder chamber 121*a*, and the compressed air inside the compression chamber 131*a* is supplied to (flows into) the cylinder chamber 121*a* via the air passage 135. When the compressed air is supplied to the cylinder chamber 121*a*, the driving piston 123 is moved forward, as shown in FIG. 7, by the action of the "air spring" generated by the compressed air. Furthermore, the elongated driver 125 of the driving piston 123, which has moved forward, strikes (hammers) the nail that is sitting (standing by) in the driving passage 141*a* of the driver guide 141. This striking (impact) causes the nail to be forcibly driven out (ejected from the ejection port) and then driven into the workpiece.

Figure 8:
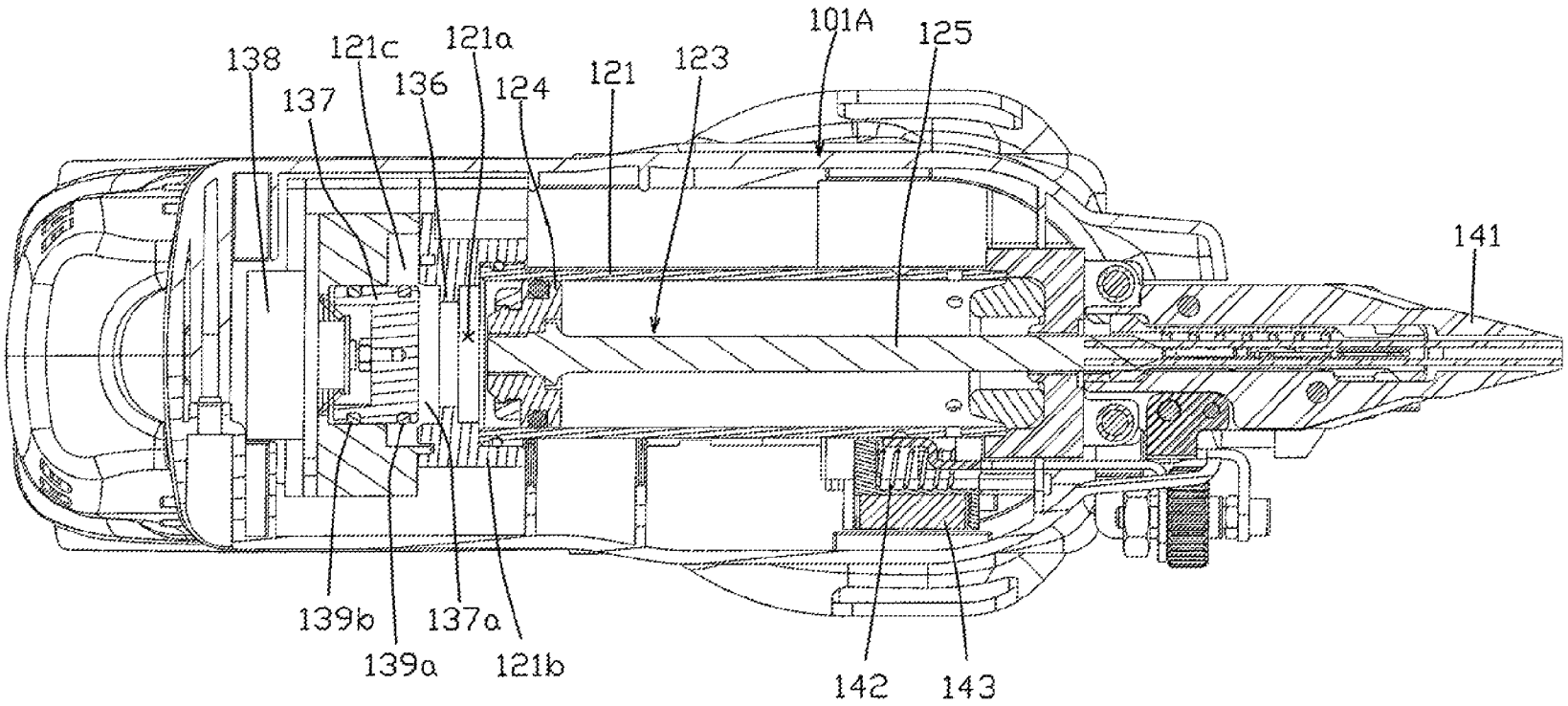
FIG. 8 shows a state in which the open state of the valve is maintained and the driving (second) piston has returned nearly to its rearward initial position shown in FIG. 6.

After the nail has been ejected, the compression piston 133 continues to move from its top dead center toward its bottom dead center. Consequently, the volume of the compression chamber 131*a* increases and the air pressure inside the compression chamber 131*a* becomes a reduced (negative) pressure, i.e. lower than atmospheric pressure. The reduced pressure that arises (is generated) inside the compression chamber 131*a* acts on the driving piston 123 via the air passage 135 and the cylinder chamber 121*a*. As shown in FIG. 8, this causes the driving piston 123 to be suctioned and moved rearward. Furthermore, the driving piston 123 makes contact with the stopper 136 and is again positioned at the initial position. The solenoid valve 137 maintains the open state of the air passage 135 until the driving piston 123 has moved to its initial position. When the driving piston 123 is positioned at the initial position, the solenoid valve 137 moves forward and closes (blocks) the air passage 135. Furthermore, the control unit 109 is configured (programmed) to cause the speed (energy) of the compression piston 133 to be actively reduced, for example, when the magnetic sensor 150 detects that the crank angle of the crankshaft 115*a* is 310°. That is, the control unit 109 generates instructions that are utilized to brake and stop the compression piston 133, preferably at its bottom dead center position or close thereto, as will be further discussed below. In addition, when the compression piston 133 is positioned at the initial position (bottom dead center), even if the trigger switch 103*b* and the contact-arm switch 143 continue to be maintained in the ON state, the flow of current to the electric motor 111 is interrupted, and thereby the electric motor 111 is stopped. Thus, one cycle of the nail driving operation ends. Preferably, the LED 107 illuminates the tip area of the driver guide 141 at least during the nail driving operation.

During the nail driving operation in the above-described nailer 100, it is possible that the flow of electric current to the electric motor 111 might be unintentionally stopped by, for example, the charge in the battery pack 110 running out (being depleted), the battery pack 110 unintentionally being disconnected, or the like. In addition, there is also a possibility that some other problem during the nail driving operation might arise (occur). In such a case, there could be situations in which the compression piston 133 is not stopped at its bottom dead center prior to the start of a (subsequent) driving operation. If the compression piston 133 is not stopped at its bottom dead center, then, when the next driving operation is started, the degree of compression of the compressed air generated by the compression piston 133 will differ in accordance with the position of the compression piston 133 at the time that the driving operation was started. Consequently, the speed that the nails are driven out (ejected) in each driving operation will not be constant, and the extent to which the nails are driven into the workpiece will vary in an adverse manner. Consequently, in the first embodiment, if the compression piston 133 is not positioned at its bottom dead center prior to the start of a driving operation, then a return operation is preferably performed before the next driving operation is initiated in order to more precisely move the compression piston 133 to its bottom dead center. This return operation is preferably performed with the air release valve formed (provided) in the compression cylinder 131 in its open state such that the compression chamber 131*a* is open to the atmosphere.

In order to perform this return operation, the magnetic sensor 150 preferably detects the position of the compression piston 133 prior to the start of the driving operation. For example, the magnetic sensor 150 may measure or detect the position of the crankshaft 115*a* at one or more of the timings below.

Timing 1: When the battery pack 110 is mounted on the battery mount area

Timing 2: When the trigger 103*a* is operated

Timing 3: When the driver guide 141 is pushed against the workpiece

That is, the magnetic sensor 150 measures the position of the crankshaft 115*a* at at least one timing selected from the above-noted Timings 1-3. Preferably, a configuration is utilized (e.g., the control unit 109 is preferably configured) such that the magnetic sensor 150 measures or detects the position of the crankshaft 115*a* at one, two or three timing(s) selected from the Timings 1-3. The timing(s), at which the magnetic sensor 150 measures (detects) the (rotational) position of the crankshaft 115*a*, is (are) preset in the control unit 109.

As was noted above, it is possible that the compression piston 133 will adversely (inappropriately) stop at a position other than its bottom dead center due to, for example, the charge of the battery pack 110 running out or the unintentional disconnection of the battery pack 110 during the nail driving operation. In order to prevent such a situation, at Timing 1, the position of the compression piston 133 may be detected by causing the magnetic sensor 150 to measure or detect the (rotational) position of the crankshaft 115*a*. In case the control unit 109 then determines from this sensor output that the compression piston 133 is (incorrectly) positioned at a position other than its bottom dead center, the control unit 109 drives the electric motor 111 to move the compression piston 133 to its bottom dead center prior to initiating another nail driving operation.

As was described above, the nailer 100 is configured such that, when one driving operation ends (i.e. the elongated drive 125 has struck or "hammered" the nail), the compression piston 133 should move from its top dead center back to its bottom dead center and be stopped precisely at its bottom dead center. Nevertheless, there can be situations in which the compression piston 133 does not stop precisely at its bottom dead center due to, for example, inertial forces that arise due to the movement of the compression piston 133, or the like. In addition, if the trigger 103*a* is prematurely released or if the pushing of the driver guide 141 against the workpiece is prematurely released after the start of the driving operation (prior to completion of the driving operation), then the compression piston 133 will be prematurely stopped during the driving operation. Then, in an attempt to start the driving operation at Timing 2, when the user operates the trigger 103*a*, the magnetic sensor 150 measures the (rotational) position of the crankshaft 115*a*. In this case, the magnetic sensor 150 may measure the position of the crankshaft 115*a* not at Timing 2 but at Timing 3. By measuring the (rotational) position of the crankshaft 115*a*, the position of the compression piston 133 can be determined. Furthermore, if the compression piston 133 is positioned at a position other than its bottom dead center, the control unit 109 is configured to drive the electric motor 111 to move the compression piston 133 to its bottom dead center prior to starting the next nail driving operation.

In addition, the nailer 100 may be configured to perform "continuous operation", wherein multiple nails are successively driven at time intervals determined by the user. That is, a continuous operation is performed by setting the nailer 100 to a "continuous operation" mode and by continuing to hold the trigger 103*a* in the pulled or squeezed position after a first driving operation has been performed. The nails are successively ejected by pulling the driver guide 141 away from the workpiece and then pushing the driver guide 141 against another portion of the workpiece, in a manner that is well known in the art. In other words, in a normal driving operation (also known as "intermittent driving/nailing", "trigger-fire driving", "sequential trip trigger", etc.), one nail is driven out for each individual actuation (squeeze) of the trigger 103*a*. On the other hand, in a continuous operation (also known as "push lever fire", "touch trip trigger", etc.), multiple nails can be successively driven out even though the trigger 103*a* has been actuated (squeezed) only one time. In a continuous operation, when the user operates the trigger 103*a* in an initial attempt to start the driving operation at timing 2, the magnetic sensor 150 measures the (rotational) position (crank angle) of the crankshaft 115*a*. Accordingly, the magnetic sensor 150 may measure the (rotational) position of the crankshaft 115*a* only prior to the start of the initial driving operation from among the plurality of driving operations. Furthermore, if a continuous operation is being performed, the magnetic sensor 150 may (also) measure the (rotational) position of the crankshaft 115*a* at Timing 3, which occurs when the driver guide 141 is pressed against the workpiece prior to each successive nail driving operation. In addition, in a continuous operation, the magnetic sensor 150 may measure the (rotational) position of the crankshaft 115*a* at Timing 2 and at Timing 3. The (rotational) position of the compression piston 133 is then determined from the measured (rotational) position of the crankshaft 115*a*. Furthermore, if the compression piston 133 is positioned at a position other than its bottom dead center, then the control unit 109 drives the electric motor 111 to move the compression piston 133 to its bottom dead center before the next nail driving operation is started.

When the return operation is performed, the control unit 109 causes the compression piston 133 to be moved to its bottom dead center (e.g., by supplying an appropriate current to the electric motor 111) such that the air inside the compression chamber 131*a* is not compressed. That is, the compression piston 133 is moved to its bottom dead center without passing through its top dead center, as will be further discussed below.

More specifically, if the magnetic sensor 150 measures (detects) that the crankshaft 115*a* is positioned (has come to a stop) at a crank angle between 0° and 180°, i.e. if the compression piston 133 is positioned (has come to a stop) at an intermediate position between its bottom dead center and its top dead center at the conclusion of the nail driving operation, then the control unit 109 causes the rotary shaft of the electric motor 111 to rotate in a reverse direction to move the compression piston 133 to its bottom dead center without passing through its top dead center. For example, the control unit 109 may cause current having an inverse polarity, as compared to forward driving, to be supplied to the electric motor 111.

On the other hand, if the magnetic sensor 150 measures (detects) that the crankshaft 115*a* is positioned (has come to a stop) at a crank angle between 180° and 360°, i.e. if the compression piston 133 is positioned (has come to a stop) at an intermediate position between its top dead center and its bottom dead center at the conclusion of the nail driving operation, then the control unit 109 causes the rotary shaft of the electric motor 111 to rotate in a forward direction (i.e. opposite to the reverse direction) to move the compression piston 133 to its bottom dead center without passing through its top dead center. Therefore, by selectively controlling the direction of the rotary output of the electric motor 111 as described above, the compression piston 133 can be moved to its bottom dead center without passing through its top dead center, thereby preventing the generation of compressed air and a possible mis-firing of a nail during the return operation.

In view of the above-noted description, the return operation can be performed according to a variety of algorithms. For example, in one non-limiting embodiment, the control unit 109 may calculate the crank angle of the crankshaft 115*a* based upon the output from the magnetic sensor 150, e.g., by solving a real-time function that correlates the output signal(s) from the magnetic sensor 150 to the instantaneous rotational position (crank angle) of the crankshaft 115, or by using a value representative of the output signal(s) as an index to a lookup table (LUT) that provides predetermined correlations between output signals from the magnetic sensor 150 and the instantaneous rotational position (crank angle) of the crankshaft 115. Then, the calculated crank angle may be used as an index of another look-up table (LUT) to select a current and polarity to drive the electric motor 111 in order to rotate the crankshaft 115*a* by the appropriate amount to return the crankshaft 115*a* to its initial position (crank angle=0°), which corresponds to the bottom dead center of the piston 133. In this regard, the current values in the LUT for calculated crank angles that are 0° or are within a range (e.g., +/−10°, +/−15°, +/−20°, etc.) may be set to zero (i.e. the crankshaft 115*a* is not rotated in case it is sufficiently close to its initial position), Optionally, the rotational position (crank angle) may be detected again after the electric motor 111 has been driven to rotate the crankshaft 115*a* and if necessary, the newly-calculated crank angle may again serve as an index for the LUT to obtain another set of current and polarity values for energizing the electric motor 111. The pre-calculated values assigned in the LUT may be predetermined and stored in a memory associated with the control unit 109 at the time of manufacture. A processor of the control unit 109 then accesses the LUT to obtain the appropriate currents and polarities for driving the electric motor 111.

In another non-limiting embodiment, the output signal(s) from the magnetic sensor 150 may be used as an index to a lookup table (LUT) that contains currents and polarities that will be suitable for rotating the crankshaft 115*a* to its bottom dead center. In other words, it may not be necessary to calculate a crank angle in an intermediate step in certain embodiments of the present teachings, because the appropriate currents and polarity for driving the electric motor 111 can be derived directly from the output signal of the sensor 150 in such embodiments.

In another non-limiting embodiment, values corresponding to the output signal(s) from the magnetic sensor 150 may be input into a real-time function (equation) that correlates the sensed rotational position of the crankshaft 115*a* to currents and polarities that will be suitable for rotating the crankshaft 115*a* to its bottom dead center. In such an embodiment as well, it may not be necessary to calculate a crank angle of the crankshaft 115*a* in an intermediate step.

As was noted above, the LED 107 preferably illuminates the tip area of the driver guide 141 during the driving operation. In addition, the control unit 109 may cause the LED 108 to flash ON and OFF during return operations. This flashing will alert the user that a return operation is currently being performed. However, it should be noted that the present teachings are not limited to configurations and embodiments in which the LED 108 is simply flashed ON and OFF. For example, it is possible to configure the LED 107 (and/or LED 108) such the color of the light radiated by the LED 107 (and/or LED 108) differs for the driving operation and the return operation.

Furthermore, as was described above in the first embodiment, when the compression piston 133 has not stopped at its bottom dead center (or within a predetermined range about its bottom dead center) after completion of a prescribed driving operation, the control unit 109 may modify the control of the braking of the compression piston 133 during the next driving operation that follows the prescribed driving operation. For the sake of convenience of explanation, the "prescribed driving operation" will be called the first driving operation and the next or subsequent driving operation will be called the second driving operation in the following.

The drive state of the nailer 100 may change during operation such that the compression piston 133 does not stop at its bottom dead center due to factors such as voltage fluctuations in the battery pack 110 or changes in the characteristics (rotary output) of the electric motor 111 due to the generation of heat that accompanies the drive of the electric motor 111. Consequently, when the magnetic sensor 150 detects a value indicative of the stopped position of the compression piston 133 after the prescribed first driving operation that is not its bottom dead center, the control unit 109 causes the electric motor 111 to be driven such that the compression piston 133 is moved to its bottom dead center and modifies the braking start timing (i.e. a braking parameter) during the subsequent second driving operation. In the present embodiment, the first driving operation and the second driving operation serve as representative examples of the "first driving operation" and the "second driving operation," respectively, in the present disclosure.

For example, if the magnetic sensor 150 measures, as a value representative of the stopped position of the compression piston 133 after completion of the first driving operation, that the crankshaft 115*a* is positioned (has come to a stop) at a crank angle between 0° and 180°, then the control unit 109 modifies the braking start timing (braking parameter) such that the braking start timing in the second driving operation is earlier than the braking start timing in the first driving operation. For example, the modifiable braking parameter in this embodiment may be the crank angle of the crankshaft 115*a*. That is, if the compression piston 133 has stopped beyond (after passing through) its bottom dead center in the first driving operation, then the braking start timing is modified in the second driving operation such that braking of the compression piston 133 is started when the crank angle of the crankshaft 115*a* is 305° (i.e. instead of the previous braking start timing of a crank angle of 310°). As a result, the amount of time that elapses between the start of movement of the compression piston 133 from its bottom dead center in the second driving operation until the braking start timing is (becomes) shorter than in the first driving operation, because the braking is initiated when the crankshaft 115*a* reaches a smaller crank angle.

On the other hand, if the magnetic sensor 150 measures, as the value representative of the stopped position of the compression piston 133 after completion of the first driving operation, that the crankshaft 115*a* is positioned (has come to a stop) at a crank angle between 180° and 360°, then the control unit 109 modifies the braking start timing such that the braking start timing in the second driving operation is later than the braking start timing in the first driving operation. For example, if the compression piston 133 stops before its bottom dead center in the first driving operation, then the braking start timing in the second driving operation is modified such that the braking of the compression piston 133 is started when the crank angle of the crankshaft 115*a* is 315° (i.e. instead of the previous braking start timing of 310°). As a result, the amount of time that elapses between the start of movement of the compression piston 133 from its bottom dead center in the second driving operation until the braking start timing is (becomes) longer than in the first driving operation, because the braking is initiated when the crankshaft 115*a* reaches a larger crank angle.

By modifying (increasing and decreasing) the braking start timings (e.g., by increasing and decreasing the crank angle at which the braking is initiated) as described above, the stopped position of the compression piston 133 after the second driving operation is closer to the bottom dead center than the stopped position of the compression piston 133 after the first driving operation. Accordingly, if the driving operations are performed continuously (successively), then in each of the $N^{th}$ and subsequent driving operations, the braking start timing in each $N^{th}$ driving operation is set based on the stopped position of the compression piston 133 after the $(N-1)^{th}$ driving operation. Furthermore, in the above-described example, the difference in the crank angle at the braking start timing in the $N^{th}$ driving operation and at the braking start timing in the $(N-1)^{th}$ driving operation is 5°, but the modification of the braking start timing is not limited to a crank angle of 5°. For example, the crank angle at the braking start timing may be changed in predetermined angular units, or may be changed in accordance with real-time calculations.

For example, the crank angle at the braking start timing may be modified in accordance with the (calculated) distance between the stopped position of the compression piston 133 and its bottom dead center. For example, if the stopped position of the compression piston 133 is, as a position in the vicinity of it bottom dead center, at a crank angle of 0°-15° (or a crank angle of 345°-360°), then, in the $N^{th}$ driving operation, 5° may be subtracted from (or added to) the crank angle of the braking start timing in the $(N-1)^{th}$ driving operation. Moreover, if the stopped position of the compression piston 133 is, as a position distant from the bottom dead center, at a crank angle of 15°-30° (or a crank angle of 330°-345°), then, in the $N^{th}$ driving operation, 10° degrees may be subtracted from (or added to) the crank angle of the braking start timing in the $(N-1)^{th}$ driving operation. Naturally, the modification of the crank angle at the braking start timing may be any other angle that is consistent with achieving the purpose of the present disclosure, and may range, e.g., between 1-30°, including any value within that range.

In the first embodiment, the control unit 109 causes the compression piston 133 to be braked by interrupting the flow of electric current to the electric motor 111. In the alternative, the control unit 109 may cause the compression piston 133 to be braked by controlling the drive of (the amount of current supplied to) the electric motor 111. For example, as other methods of braking the compression piston 133, the control unit 109 may perform, e.g., short-circuit control (i.e. short-circuit or connect the power terminals of the motor 111, e.g., via a braking resistor, i.e. rheostatic braking) or pulse width modulation (PWM) control on the electric motor 111 to actively reduce the speed of the electric motor 111 by applying a current of inverse polarity to before perform electrical braking. Regenerative braking is also possible.

The modification of the braking control in the second driving operation relative to the braking control in the first driving operation is particularly useful when carrying out a continuous operation. That is, in a continuous operation, in which multiple nails are driven successively while the user continuously squeezes the trigger 103*a*, the remaining battery charge of the battery pack 110 will vary (diminish) and/or the electric motor 111 may generate a large amount of heat. Accordingly, if only preset (unchangeable) braking control is used, then the stopped position of the compression piston 133 after each nail driving operation tends to vary. However, by detecting (directly or indirectly) the position of the compression piston 133 after each driving operation ends and subsequently modifying the braking control according to the present teachings, the compression piston 133 can be stopped appropriately at (or at least much closer to) its bottom dead center. Furthermore, in a continuous operation, each initial driving operation corresponds to the first driving operation, and the following driving operation(s) correspond(s) to the second driving operation. Therefore, the modification of the braking control in the second driving operation relative to the braking control in the first driving operation may be applied to a plurality of single or individual (intermittent) driving operations, in which each single or individual driving operation involves the driving of one nail for each individual actuation (squeeze) of the trigger 103*a*.

In the above-described first embodiment, although the braking start timing is set based on the (rotational or angular) position (the crank angle) of the crankshaft 115*a* detected by the magnetic sensor 150, the present disclosure is not limited to such embodiments. For example, the control unit 109 may have a timer and the elapsed time from the start of movement of the compression piston 133 from its bottom dead center may be measured in each driving operation. In this case, a value representative of the (instantaneous) crank angle of the crankshaft 115*a* may be calculated based upon the elapsed time measured by the timer and the number of revolutions of the electric motor 111. Accordingly, the braking start timing in each driving operation may be set based on the elapsed time, which corresponds to the crank angle of the crankshaft 115*a*. In such an embodiment, the measurement time of the timer is preferably reset (to zero)

when the compression piston 133 is positioned at its bottom dead center (a 0° crank angle of the crankshaft 115*a*) after each driving operation ends.

Various algorithms may be utilized to implement embodiments according to this aspect of the present teachings. For example, the control unit 109 may include a timer that is started when the crankshaft 115*a* starts to rotate from its bottom dead center to initiate a nail driving operation. The modifiable braking parameter may be a stored amount of time. When the timer reaches the stored amount of time, the control unit 109 controls (brakes) the electric motor 111 by supplying a prescribed (predetermined) current (e.g. continuous or according to PWM control) and polarity to the electric motor 111 or by shorting (connecting) the power terminals of the electric motor 111 (e.g., via a braking resistor). Then, the stopped position of the compression piston 133 and/or of the crankshaft 115*a* is measured (determined), e.g., using the magnetic sensor 150 according to one of the methods described above (e.g., by performing a real-time calculation or by using a lookup table). The control unit 109 may then compare a value representative of the stopped position of the compression piston 133 or the crankshaft 115*a* to a stored value representative of bottom dead center. If the value representative of the stopped position is greater than the stored value, then the control unit 109 reduces or decrements the stored amount of time for initiating the braking, so that the braking will be initiated earlier in the next nail driving operation. On the other hand, if the value representative of the stopped position is less than the stored value, then the control unit 109 increases or increments the stored amount of time for initiating the braking, so that the braking will be initiated earlier in the next nail driving operation. The amount of the incrementing or decrementing may be fixed (i.e., the same amount of time is added to or subtracted from the stored amount of time regardless of how much the stopped position deviates from the bottom dead center), or may be varied (e.g., a greater amount of time is added to or subtracted from the stored amount of time as the stopped position deviates more greatly from the bottom dead center). Again, it is possible to use a real-time calculation or a lookup table to determine the amount of change of the stored braking start timing.

Second Embodiment

In the above-described first embodiment, the control unit 109 is configured such that, in the first driving operation and in the second driving operation, it modifies the braking start timing, e.g., by changing a stored amount of time or by changing a stored crank angle when the braking of the compression piston 133 is initiated. However, in the second embodiment that will be described in the following, the braking force may be modified without modifying the braking start timing, in order to achieve a stopped position of the compression piston 133 after the second driving operation that is closer to its bottom dead center than after the first driving operation. It is noted that, except for the modification of the braking control, the configuration of the nailer 100 may be the same as that of the first embodiment; therefore the same reference numerals are assigned to the same structural elements as the first embodiment and an explanation of such structural elements may be omitted (i.e. the disclosure of the first embodiment is incorporated by reference into the present second embodiment with respect to the structural elements).

For example, in the second embodiment, the braking control may be modified such that the short-circuit control of the electric motor 111 and/or the PWM control of the electric motor 111 differ in terms of the rate by which the speed of the electric motor 111 is reduced, i.e. the deceleration rate. That is, the braking force applied to the compression piston 133 (e.g., via the electric motor 111) may differ in successive nail driving operations. It is noted that, in PWM control, the braking force is determined based on the duty ratio of the pulsed waves (application of electric current). In the nailer 100, PWM control with a predetermined duty ratio is set (stored) as the braking control to be performed on the electric motor 111 at the time of manufacture. However, the braking force (which may be determined by the braking duty ratio) serves as a modifiable braking parameter in the second embodiment, and may be changed after each nail driving operation based upon the determination as to the stopped position of the compression piston 133 (or a value representative thereof).

According to the second embodiment, when the stopped position of the compression piston 133 after the first driving operation (or a value representative thereof) is detected by the magnetic sensor 150 as not being its bottom dead center (or within a predetermined angular range about bottom dead center), the control unit 109 drives the electric motor 111 (as was described in detail in the first embodiment) to move the compression piston 133 to its bottom dead center and modifies the braking force (i.e. the stored braking parameter) to be applied when the second (next) driving operation is performed. In the second driving operation, the braking force may be modified, e.g., by modifying the stored duty ratio of the PWM control or by switching to short-circuit control. As a result, the control unit 109 modifies the braking force in the first driving operation and in the second driving operation without modifying the braking start timing (which may be determined, e.g., by a timer or by sensing the rotational position (crank angle) of the crankshaft 115*a*). Furthermore, the braking force in the second driving operation is determined based on the (calculated) distance (deviation) between the (calculated) stopped position of the compression piston 133 after the first driving operation and its bottom dead center. In addition, the time until the compression piston 133 stops (the braking time) is determined based on the braking force. In other words, in the second embodiment, the braking time (i.e. the amount of time that it takes for the piston 113 to come to a stop after initiating the application of the braking force) is modified without modifying the braking start timing. The braking distance is thus also changed.

Various algorithms may be utilized to implement embodiments according to this aspect of the present teachings. As was noted above, the modifiable braking parameter in this embodiment is the amount of braking force that is applied to the compression piston 133. The braking start timing may be determined according to any of the above-described algorithms, e.g., by using a timer or by sensing the crank angle of the crankshaft 115*a*. Similarly, the stopped position of the compression piston 133 and the deviation (if any) of the stopped position from the bottom dead center (or a predetermined range about the bottom dead center) may be determined according to any of the above-described algorithms. In the present embodiment, the control unit 109 may control (brake) the electric motor 111 by supplying a variable current (e.g. continuous or according to PWM control) of opposite polarity to the electric motor 111 or by shorting (connecting) the power terminals of the electric motor 111 (e.g., via one or more braking resistors). If the control unit 109 determined (according to any of the above-described algorithms) that a value representative of the stopped position of the compression piston 133 is greater than (beyond) a stored value representative of its bottom dead center, then the control unit 109 increases or increments the stored braking force, so that the braking will be performed (applied) more forcefully in the next nail driving operation. On the other hand, if the value representative of the stopped position of the compression piston 133 is less than (before) the stored value representative of its bottom dead center, then the control unit 109 decreases or decrements the stored braking force, so that the braking will be performed (applied) less forcefully in the next nail driving operation. The amount of the incrementing or decrementing may be fixed (i.e., the same amount (unit) of braking force is added to or subtracted from the stored amount (unit) of braking force regardless of how much the stopped position deviates from the bottom dead center), or may be varied (e.g., a greater amount of braking force is added to or subtracted from the stored amount of braking force as the stopped position deviates more greatly from the bottom dead center). Again, it is possible to use a real-time calculation or a lookup table to determine the amount of change of the stored braking force, which may be applied to the electric motor 111, e.g., in the form of a variable current of opposite polarity to the current applied for forward (normal) driving of the compression piston 133. In the alternative, the electric motor 111 may be variably braked by changing the resistance applied in a short-circuiting operation, e.g., by selectively connecting one or more braking resistors that are connected in parallel between the power terminals of the electric motor 111. A combination of PWM control and short-circuit braking also may be utilized depending upon the design.

According to each of the above-described first and second embodiments, the compression piston 133 is preferably moved to its bottom dead center prior to the start of each driving operation, and consequently the degree of compression of the air compressed by the compression piston 133 can be made constant in every driving operation. Thereby, every driven article (fastener, nail, staple, etc.) is driven at (or very close to) a prescribed speed in every driving operation.

In addition, according to each of the embodiments, when multiple driving operations are performed successively, braking control is modified in each driving operation such that the compression piston 133 stops at or much more closely to its bottom dead center. Accordingly, the multiple driving operations are performed smoothly and accurately. In addition, because braking adjustments are made such that the compression piston 133 stops at (or much closer to) its bottom dead center, the time needed to move the compression piston 133 to its bottom dead center prior to each driving operation can be reduced. The nail driving time interval can thus be significantly reduced in continuous operations because smaller adjustments of the stopped position of the compression piston 133 between nail driving operations become necessary.

In addition, according to each of the embodiments, the magnetic sensor 150 does not necessarily measure the compression piston 133 directly. That is, there is no need to directly measure the position of a movable element that is surrounded by the (opaque) compression cylinder 131 or the like, such as the compression piston 133. Accordingly, the position of the compression piston 133 can be easily determined in an indirect manner by measuring the rotational position (crank angle) of the crankshaft 115*a*, the rotational position (crank angle) of the motor shaft of the electric motor 111, or another moveable element in the drive chain between the electric motor 111 and the compression spring 133.

In addition, according to each of the embodiments, the compression piston 133 is moved (returned) to its bottom dead center between nail driving operations without the compression piston 133 passing through its top dead center. Consequently, the air inside the compression cylinder 131 is not compressed when the compression piston 133 is moved (returned to its bottom dead center). Accordingly, an unintentional driving (mis-firing) of a nail is prevented when the compression piston 133 is being moved (returned) to its bottom dead center.

Furthermore, each of the above-described embodiments may be configured such that, if the position of the compression piston 133 after the first driving operation is within a prescribed (predetermined) range in the vicinity of its bottom dead center, then braking control in the second driving operation is not modified. For example, each of the embodiments may be configured such that, if the control unit 109 detected that, for example, the compression piston 133 after the first driving operation is stopped at a crank angle of the crankshaft 115*a* in a range corresponding to 330° to 360°, then braking control in the second driving operation is not modified.

In addition, in each of the embodiments, the control unit 109 controls the drive (energization) of the electric motor 111 in order to cause the compression piston 133 to be braked, but the present disclosure is not limited to such embodiments. For example, a (separate) braking apparatus may be provided that comprises a brake shoe configured to frictionally contact the crankshaft 115*a* or motor shaft in order to actively reduce its rotational speed and bring it to a stop.

In addition, although it was described in each of the embodiments that the solenoid valve 137 is used as the valve member for opening and closing the air passage 135, a mechanical valve that is mechanically operated may be used instead.

In addition, although the magnetic sensor 150 measures the position of the crankshaft 115*a* in each of the embodiments, the present disclosure is not limited to such embodiments. For example, the magnet 151 may be attached to the motor shaft of the electric motor 111, and the magnetic sensor 150 may detect the position of the compression piston 133 by measuring the rotational position of the motor shaft. If the position of the motor shaft is measured, then the crank angle of the crankshaft 115*a* is calculated based on the total number of revolutions of the motor shaft since the start of movement of the compression piston 133 from its bottom dead center and based on the rotational position (angle) of the motor shaft. Furthermore, the total number of revolutions of the motor shaft is reset when one driving operation ends. In addition, each embodiment may be configured such that the magnetic sensor 150 measures the position of the compression piston 133. Furthermore, in addition to a magnetic sensor, a photointerrupter (optical rotary encoder), which comprises a light receiving part and a light emitting part, etc. may be used, as the sensor.

Furthermore, although each of the embodiments described the nailer 100 as the representative example of a driving tool according to the present teachings, the present disclosure may be applied to driving tools other than nailers, such as tackers, staplers, and the like. The driven articles may be any kind of fastener, such as nails, staples, tacks, etc., that can be forcibly driven into a workpiece. Moreover, although the magazine 105 is straight (stick-stick magazine)

in the present embodiments, the present teachings are of course applicable to magazines (coil-style magazines) that hold a coil of fasteners. In addition, the driving tool is not limited to cordless tools, i.e. to which the battery pack 110 is mounted, and may be any corded tool in which electric power is supplied via a power supply cord. In addition, instead of the electric motor 111, an internal combustion engine (which combusts pressurized fuel in a manner similar to a two-stroke engine) or the like may be used as the drive mechanism.

Taking into consideration the above objects of the present disclosure, the following aspects of the driving tool according to the present disclosure are also configurable.

(Aspect 1)

A driving tool according to any embodiment, aspect or claim disclosed herein, wherein the controller comprises a timer;

the timer measures, in each driving operation, the elapsed time since the start of movement of the first piston from its bottom dead center;

the controller is configured such that, in the first driving operation, the first piston is braked when the elapsed time measured by the timer becomes a first (amount of) time; and if the stop position of the first piston after the first driving operation ends is a position other than its bottom dead center, then:

the controller is configured such that, in the second driving operation, the first piston is braked when the (elapsed) amount of time measured by the timer becomes a second (amount of) time that is different from the first (amount of) time.

(Aspect 2)

A driving tool according to any embodiment, aspect or claim disclosed herein, wherein if the stop position of the first piston after the first driving operation ends is within a prescribed range that includes the bottom dead center, then the controller does not modify braking control in the second driving operation; and if the stop position of the first piston after the second driving operation ends is outside of the prescribed range, then the controller is configured such that it modifies the braking control performed on the first piston such that the stop position of the first piston after the second driving operation ends is closer to the bottom dead center than after the first driving operation ended.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved driving (power) tools.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although some aspects of the present disclosure have been described in the context of a device, it is to be understood that these aspects also represent a description of a corresponding method, so that a block or a component of a device is also understood as a corresponding method step or as a feature of a method step. In an analogous manner, aspects which have been described in the context of or as a method step also represent a description of a corresponding block or detail or feature of a corresponding device.

Depending on certain implementation requirements, exemplary embodiments of the control unit 109 of the present disclosure may be implemented in hardware and/or in software. The implementation can be performed, e.g., using a digital storage medium, such as a ROM, a PROM, an EPROM, an EEPROM or a flash memory, on which electronically readable control signals (program code or instructions) are stored, which interact or can interact with a programmable hardware component such that the respective method is performed.

The programmable hardware component of the control unit 109 can be formed or embodied by a processor, a computer processor (CPU=central processing unit), an application-specific integrated circuit (ASIC), an integrated circuit (IC), a computer, a system-on-a-chip (SOC), a programmable logic element, and/or a field programmable gate array (FGPA) including a microprocessor.

The digital storage medium can therefore be machine- or computer readable. Some exemplary embodiments thus comprise a data carrier or non-transitory computer readable medium which includes (stores) electronically readable control signals, which are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is stored.

In general, exemplary embodiments of the present disclosure, in particular the control unit 109 or a "controller", are implemented as a program, firmware, computer program, or computer program product including a program, or as data, wherein the program code or the data is operative to perform one of the methods when the program runs on a processor or on a programmable hardware component. The program code, instructions or data can for example also be stored on a machine-readable carrier or data carrier. The program code, instructions or data can be, e.g., source code, machine code, bytecode or another intermediate code.

A program according to an exemplary embodiment can implement one of the methods during its performance, for example, such that the program reads storage locations or writes one or more data elements into these storage locations, wherein switching operations or other operations are induced in transistor structures, in amplifier structures, or in other electrical, optical, magnetic components, or components based on another functional principle. In this regard, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes using the electric motor 111 and other mechanical structures of the electro-pneumatic driving tool.

In the above-described embodiments, a magnetic sensor 150 incorporating a magnet 151 and a Hall-effect device 152 was described as one exemplary embodiment of a rotary encoder for determining the rotational position (crank angle) of the crankshaft 115*a*. However, the present teachings are not limited to magnetic rotary encoders, and the magnetic sensor 150 may be replaced, e.g., with an optical rotary encoder, mechanical rotary encoder, a capacitive rotary encoder, etc. A linear relationship exists between the value (signal) output by the rotary encoder and the position of the compression piston 133 within the compression cylinder 131 such that the sensed rotational position (crank angle) of the crankshaft 115*a* can be used, e.g., without further processing, as a value corresponding to the position of the compression piston 133 within the compression cylinder 131.

REFERENCE NUMBER LIST

100 Nailer
101 Main-body housing
101A Driving-mechanism housing part
101B Compressing-apparatus housing part
101C Motor-housing part
102 Inner-side housing
103 Handle part
103*a* Trigger
103*b* Trigger switch
105 Magazine
105*a* Pusher plate
107 LED
108 LED
109 Control unit
110 Battery pack
111 Electric motor
113 Planetary-gear-type, speed-reducing mechanism
115 Crank mechanism
115*a* Crankshaft
115*b* Eccentric pin
115*c* Connecting rod
120 Nail-driving mechanism
121 Driving cylinder
121*a* Cylinder chamber
121*b* Cylinder head
121*c* Annular groove
123 Driving piston
124 Piston-main-body part
125 Driver
130 Compression apparatus
131 Compression cylinder
131*a* Compression chamber
131*b* Cylinder head
133 Compression piston
135 Air passage
135*a* Communication port
135*b* Communication port
135*c* Communication path
136 Stopper
137 Solenoid valve
137*a* Valve chamber
138 Electromagnet
139*a* O-ring
139*b* O-ring
141 Driver guide
141*a* Driving passage
142 Biasing spring
143 Contact-arm switch
150 Magnetic sensor
151 Magnet
152 Hall-effect device

The invention claimed is:

1. A driving tool configured to drive a driven article out of an ejection port, comprising:

a first cylinder;

a first piston slidably housed within the first cylinder;

a drive mechanism configured to drive the first piston;

a second cylinder in fluid communication with the first cylinder;

a second piston slidably housed within the second cylinder;

a communication path providing fluid communication between the first cylinder and the second cylinder;

a valve member provided in the communication path;

a sensor configured to directly or indirectly detect the position of the first piston; and a controller configured to control movement of the first piston and operation of the driving tool such that:

the first piston is driven from its bottom dead center to its top dead center while the valve member is closed and fluid communication between the first cylinder and the second cylinder is blocked, in order to generate compressed air inside the first cylinder;

the valve member is then opened to supply the compressed air inside the first cylinder to the second cylinder via the communication path and cause the second piston to move and strike the driven article so that it driven out of the ejection port;

the first piston is stopped at a stopped position by braking the first piston with the drive mechanism or a brake after the first piston has passed through its top dead center; and if the controller determines that the stopped position of the first piston detected by the sensor after a first driving operation ends is at a position other than its bottom dead center, then the braking of the first piston is adjusted such that the stopped position of the first piston after a second driving operation ends, which follows the first driving operation, is closer to its bottom dead center than after the first driving operation ended.

2. The driving tool according to claim 1, wherein the controller is configured such that:

the braking of the first piston in the first driving operation occurs when a first amount of time has elapsed since the start of movement of the first piston from its bottom dead center; and if the controller determines that the stopped position of the first piston after the first driving operation ends is a position other than the bottom dead center, then the braking of the first piston in the second driving operation occurs when a second amount of time, which differs from the first amount of time, has elapsed since the start of movement of the first piston from its bottom dead center.

3. The driving tool according to claim 2, wherein the controller is configured such that:

in the first driving operation, if the controller determines that the first piston has stopped after passing beyond its bottom dead center, then the controller sets the second amount of time to be shorter than the first amount of time; and the braking of the first piston in the second driving operation occurs when the second amount of time has elapsed since the start of movement of the first piston from its bottom dead center.

4. The driving tool according to claim 2, wherein the controller is configured such that:

in the first driving operation, if the controller determines that the first piston has stopped before its bottom dead center, then the controller sets the second time to be longer than the first time; and the braking of the first piston in the second driving operation occurs when the second amount of time has elapsed since the start of movement of the first piston from its bottom dead center.

5. The driving tool according to claim 1, wherein the controller is configured such that:

in the first driving operation, when a predetermined amount of time has elapsed since the start of movement of the first piston from its bottom dead center, the braking of the first piston produces a first braking force; and if the controller determines that the stopped position of the first piston after the first driving operation ends is a position other than the bottom dead center, then in the second driving operation, when the predetermined amount of time has elapsed since the start of movement of the first piston from its bottom dead center, the braking of the first piston produces a second braking force that differs from the first braking force.

6. The driving tool according to claim 1, wherein the controller is configured such that:

in the first driving operation, the braking of the first piston is continuous for a first amount of braking time when a predetermined amount of time has elapsed since the start of movement of the first piston from its bottom dead center; and if the controller determines that the stopped position of the first piston after the first driving operation ends is a position other than the bottom dead center, then in the second driving operation, when the predetermined amount of time has elapsed since the start of movement of the first piston from the bottom dead center, the braking of the first piston is continuous for a second amount of braking time that differs from the first amount of braking time.

7. The driving tool according to claim 1, wherein:

the drive mechanism comprises a crank mechanism configured to reciprocally drive the first piston;

the crank mechanism comprises a crankshaft and a linking member, which links the crankshaft to the first piston;

the sensor is configured to output a detection result based upon a detected position of the crankshaft; and the controller is configured to:

calculate a crank angle of the crankshaft based on the detection result of the sensor;

cause the braking of the first piston in the first driving operation when the crank angle is a first angle; and if the controller determines that the stopped position of the first piston after the first driving operation ends is a position other than its bottom dead center, then in the second driving operation, the controller is configured to cause the braking of the first piston when the crank angle is a second angle that differs from the first angle.

8. The driving tool according to claim 7, wherein the controller is configured such that:

in the first driving operation, if the controller determines that the first piston has stopped after passing beyond its bottom dead center, then the controller sets the second angle to be smaller than the first angle; and the braking of the first piston in the second driving operation occurs when the crank angle is the second angle.

9. The driving tool according to claim 7, wherein the controller is configured such that:

in the first driving operation, if the controller determines that the first piston has stopped before its bottom dead center, then the controller sets the second angle to be larger than the first angle; and the braking of the first piston in the second driving operation occurs when the crank angle is the second angle.

10. The driving tool according to claim 1, wherein:

the drive mechanism comprises an electric motor configured to drive the first piston; and the controller is configured to cause the braking of the first piston by controlling the current supplied to the electric motor.

11. The driving tool according to claim 1, wherein:

the drive mechanism comprises a crank mechanism configured to drive the first piston;

the crank mechanism comprises a crankshaft and a linking member, which links the crankshaft to the first piston;

the sensor is configured to output a detection result based upon a detected position of an element selected from the group consisting of the crankshaft, the linking member, and a rotary shaft of an electric motor drivably coupled to the crankshaft; and the controller is configured to calculate a value representative of the position of the first piston based on the detection result of the sensor.

12. The driving tool according to claim 1, wherein the controller and the sensor are configured to calculate a value representative of the position of the first piston prior to the start of each driving operation; and the controller is configured such that if the controller determines, based upon the calculated value, that the position of the first piston is a position other than its bottom dead center, then the controller causes the first piston to be moved to its bottom dead center prior to initiating the driving operation.

13. The driving tool according to claim 1, wherein:

the drive mechanism includes an electric motor operably coupled to the first piston;

the sensor is configured to sense the position of a movable element that is representative of the position of the first piston relative to the first cylinder;

the controller includes a non-transitory computer readable memory medium that stores instructions and one or more braking parameters; and the controller also includes a programmable hardware component configured to read the instructions and the one or more braking parameters stored in the non-transitory computer readable memory medium and to execute the instructions in order to control operation of the driving tool, wherein the instructions, when executed, cause the programmable hardware component to:

cause the braking of the first piston based upon the one or more stored brake parameters after the first piston passes through its top dead center to stop the first piston at a stopped position and conclude a fastener driving operation, calculate a value representative of the stopped position of the first piston based upon an output signal collected from the sensor, determine whether the calculated value representative of the stopped position of the first piston is outside of a predetermined range that corresponds to an angular range about the bottom dead center of the first piston, in response to a determination that the calculated stopped position of the first piston is outside of the predetermined range, change one or more of the stored braking parameters; and cause the braking of the first piston in a subsequent fastener driving operation based, at least in part, upon the one or more changed stored braking parameters such that the stopped position of the first piston after the second driving operation ends is closer to its bottom dead center than after the first driving operation ended.

14. The driving tool according to claim 13, wherein the one or more stored braking parameters include a braking start time after start of movement of the first piston from its bottom dead center; and the instructions to change one or more of the stored braking parameters include:

increasing the stored braking start timing when the calculated stopped position of the first piston is determined to be before its bottom dead center and decreasing the stored braking start timing when the calculated stopped position of the first piston is determined to be beyond its bottom dead center.

15. The driving tool according to claim 13, wherein the one or more stored braking parameters include a braking force applied to the first piston; and the instructions to change one or more of the stored braking parameters include:

decreasing the stored braking force applied to the first piston when the calculated stopped position of the first piston is determined to be before its bottom dead center and increasing the stored braking force applied to the first piston when the calculated stopped position of the first piston is determined to be beyond its bottom dead center.

16. The driving tool according to claim 13, wherein the one or more stored braking parameters include an amount of time that braking is applied to the first piston; and the instructions to change one or more of the stored braking parameters include:

decreasing the stored amount of time that braking is applied to the first piston when the calculated stopped position of the first piston is determined to be before its bottom dead center and increasing the stored amount of time that braking is applied to the first piston when the calculated stopped position of the first piston is determined to be beyond its bottom dead center.

17. The driving tool according to claim 13, wherein:

the drive mechanism further includes a crankshaft operably coupled between the electric motor and the first piston, the sensor is configured to sense a crank angle of the crankshaft, the instructions to calculate a value representative of the stopped position of the first piston include instructions to calculate a stopped crank angle of the crankshaft at the conclusion of the fastener driving operation based upon the output signal collected from the sensor, the one or more stored braking parameters include a crank angle value;

the programmable hardware component is configured to initiate the application of the braking to the first piston when the sensed crank angle of the crankshaft equals the stored crank angle value; and the instructions to change one or more of the stored braking parameters include:

increasing the stored crank angle value when the calculated stopped crank angle is before a bottom dead center of the crankshaft and decreasing the stored crank angle value when the calculated stopped crank angle is beyond the bottom dead center of the crankshaft.

18. The driving tool according to claim 17, wherein the instructions to cause the braking of the first piston include instructions to apply electric braking to the electric motor.

19. The driving tool according to claim 18, wherein the instructions further include instructions to:

energize the electric motor to rotate the crankshaft to its bottom dead center before initiating the subsequent fastener driving operation in response to a determination that the calculated stopped crank angle is outside a predetermined crank angle range about the bottom dead center of the crankshaft.

20. A method for operating the driving tool according to claim 1 to drive a fastener into a workpiece, comprising:

driving the first piston from its bottom dead center to its top dead center while the valve member closes the communication path and blocks fluid communication between the first cylinder and the second cylinder, wherein compressed air is generated inside the first cylinder;

subsequently opening the valve member to supply the compressed air inside the first cylinder to the second cylinder via the communication path, wherein the compressed air causes the second piston to move and drive the fastener into the workpiece;

after the first piston has passed through its top dead center, applying braking to the first piston according to one or more braking parameters, wherein the first driving operation is concluded when the first piston comes to a stop at the stopped position;

determining whether the stopped position is within a predetermined range about the bottom dead center of the first piston; and when the stopped position is outside of the predetermined range, changing one or more of the braking parameters in a second driving operation to cause the first piston to stop closer to its bottom dead center after conclusion of the second driving operation.

* * * * *